US012310491B1

(12) United States Patent
Birza

(10) Patent No.: US 12,310,491 B1
(45) Date of Patent: May 27, 2025

(54) TABLE WITH ARTICULABLE LEG SYSTEM

(71) Applicant: Brian Demoulin Birza, Denver, CO (US)

(72) Inventor: Brian Demoulin Birza, Denver, CO (US)

(73) Assignee: Anywhere Tables LLC, Lakewood, CO (US)

( * ) Notice: Subject to any disclaimer, the term of this patent is extended or adjusted under 35 U.S.C. 154(b) by 85 days.

(21) Appl. No.: 17/980,484

(22) Filed: Nov. 3, 2022

(51) Int. Cl.
*A47B 3/06* (2006.01)
*A47B 9/16* (2006.01)
*A47B 3/08* (2006.01)

(52) U.S. Cl.
CPC ..... *A47B 3/06* (2013.01); *A47B 9/16* (2013.01); *A47B 2003/0821* (2013.01); *A47B 2003/0824* (2013.01); *A47B 2200/0051* (2013.01)

(58) Field of Classification Search
CPC ..... A47B 13/021; A47B 13/003; A47B 2003/0824; A47B 2003/0821; A47B 3/06; A47B 9/16; A47B 2200/0051
USPC .... 108/129, 115, 127, 131, 132, 156, 157.1, 108/157.18, 159.11, 159.1, 2, 58.12, 108/158.13; 248/188, 188.6, 188.1, 248/288.31, 439; 403/56
See application file for complete search history.

(56) References Cited

U.S. PATENT DOCUMENTS 1,975,157 A * 10/1934 Kraft ..... G09F 3/202 40/607.1
2,327,050 A 8/1943 Kotler
2,333,784 A * 11/1943 Harris ..... D06F 81/02 108/63
3,131,898 A * 5/1964 Ewing ..... A47B 13/021 248/188
3,805,710 A 4/1974 Leshem
4,135,691 A * 1/1979 Wiesmann ..... A47B 3/0809 248/439
5,161,766 A * 11/1992 Arima ..... A47B 23/02 248/458
5,795,092 A * 8/1998 Jaworski ..... F16C 33/103 403/56

(Continued)

FOREIGN PATENT DOCUMENTS

CN 106595586 A * 4/2017 ..... G01C 9/02
CN 107811408 A * 3/2018

(Continued)

OTHER PUBLICATIONS

English translation CN106595586 (Year: 2017).*

(Continued)

*Primary Examiner* — Janet M Wilkens
(74) *Attorney, Agent, or Firm* — Brownstein Hyatt Farber Schreck LLP

(57) ABSTRACT

A table with an articulable leg system may include a table top, a set of legs configured to support the table top relative to a ground structure, and a leg retention mechanism configured to couple a leg of the set of legs to the table top, the leg retention mechanism operable in an unsecured configuration in which the leg is movable, relative to the table top, (Continued)

about at least two angular degrees of freedom and a secured configuration in which the leg is fixed relative to the table top. The leg may include a ball portion and a strut portion, and the leg retention mechanism may be configured to receive the ball portion therein.

20 Claims, 28 Drawing Sheets

(56) References Cited

U.S. PATENT DOCUMENTS 6,220,556 B1 * 4/2001 Sohrt ..... F16C 11/106 403/56
6,520,587 B2 * 2/2003 Noiseux ..... A61G 15/12 297/411.39
6,767,153 B1 * 7/2004 Holbrook ..... F16C 11/0604 403/56
7,624,737 B2 * 12/2009 Klemm ..... A47C 16/00 5/624
8,667,903 B1 * 3/2014 Goltry ..... A47B 1/05 108/4
9,498,054 B2 11/2016 Roy et al.
2002/0084389 A1 * 7/2002 Larson ..... A47B 21/00 248/371
2005/0039642 A1 * 2/2005 Cornelius ..... A47B 7/02 108/115
2007/0012480 A1 * 1/2007 Lefebvre ..... H02G 3/32 174/480
2010/0034579 A1 * 2/2010 He ..... F16C 11/0604 403/56
2015/0173506 A1 * 6/2015 Carter ..... A47B 19/00 248/445

FOREIGN PATENT DOCUMENTS

KR 101397361 5/2014
WO WO-2014135919 A1 * 9/2014 ..... A47B 13/003

OTHER PUBLICATIONS

English translation CN107811408 (Year: 2018).*
2021 CellularOutfitter.com, Universal Lazy Spider Mount for Phone and Tablet Stand on any Even or Uneven Surfaces, Bed, Sofa, Table, Countertop with Adjustable Legs.
2021 REI Co-op, Camp Adjustable Roll Table.
Adjustable Height Portable Folding Steel Welding Table and Workbench by Dewalt, downloaded from The Home Depot website.

* cited by examiner

TABLE WITH ARTICULABLE LEG SYSTEM

FIELD

The subject matter of this disclosure relates generally to tables and, more particularly, to tables with adjustable legs.

BACKGROUND

Outdoor furniture is used frequently in outdoor recreation. For example, portable tables and chairs are commonly used for camping, fishing, tailgating, and the like. In many cases, furniture for use in such environments is lightweight, portable, and/or collapsible to allow for easy transport, setup, and teardown.

SUMMARY

A table with an articulable leg system may include a table top, a set of legs configured to support the table top relative to a ground structure, and a leg retention mechanism configured to couple a leg of the set of legs to the table top, the leg retention mechanism operable in an unsecured configuration in which the leg is movable, relative to the table top, about at least two angular degrees of freedom and a secured configuration in which the leg is fixed relative to the table top. The leg may include a ball portion and a strut portion, and the leg retention mechanism may be configured to receive the ball portion therein.

The ball portion may be positioned in a socket of the leg retention mechanism, and the leg retention mechanism may include a base portion fixedly coupled to the table top and defining a first portion of the socket, and an articulating portion coupled to the base portion and defining a second portion of the socket. The leg retention mechanism may further include a latch mechanism and, in the secured configuration, the latch mechanism may secure the base portion of the leg retention mechanism to the articulating portion of the leg retention mechanism and cause the first and second portions of the socket to impart a retention force on the ball portion of the leg. The socket may include a slip-resistant lining. The ball portion may define a dimpled outer surface, and the socket may define at least one protrusion configured to engage a first dimple of the dimpled outer surface when the ball portion is in a first orientation in the socket, and engage a second dimple of the dimpled outer surface when the ball portion is in a second orientation in the socket.

The ball portion may include a body structure formed of a first material, and an outer structure defining an exterior surface of the ball portion and formed of a second material different than the first material. The first material may be metal, and the second material may be a polymer.

The strut portion may be an upper strut portion, and the leg may further include a lower strut portion coupled to the upper strut portion and positionable in different positions relative to the upper strut portion to adjust an overall length of the leg.

A table with an articulable leg system may include a table top, a set of legs configured to support the table top relative to a ground structure, a leg of the set of legs including a ball portion and a strut portion extending from the ball portion, and a set of leg retention mechanisms coupled to a bottom of the table top and configured to couple the set of legs to the table top, a leg retention mechanism of the set of leg retention mechanisms defining a socket configured to receive the ball portion at least partially therein and operable in an unsecured configuration in which the ball portion is movable in the socket to allow the leg to gimbal relative to the table top and a secured configuration in which the ball portion is fixed within the socket to fix the position of the leg relative to the table top.

The ball portion may be attached to the strut portion via a threaded post. The leg may further include a foot portion coupled to the strut portion, and the foot portion may be positionable in different positions relative to the strut portion to adjust an overall length of the leg. The strut portion may include an upper strut portion, a lower strut portion coupled to the upper strut portion and positionable in different positions relative to the upper strut portion to adjust the overall length of the leg, and the foot portion may be coupled to the lower strut portion. The table may further include a slip-resistant coating positioned on at least one of the ball portion of the leg or a surface of the socket.

A table system with a modular accessory system may include a table top and a set of four legs coupled to a bottom of the table top and configured to support the table top relative to a ground structure, each respective leg configured to gimbal relative to the table top independently of each other leg, each respective leg operable in an unlocked configuration in which a respective leg is movable relative to the table top, and a locked configuration in which the respective leg is fixed relative to the table top, wherein the table top defines an accessory retention feature along at least one peripheral side of the table top and configured to removably retain a table accessory to the table top.

The accessory retention feature may be an accessory retention slot configured to receive an engagement feature of the table accessory therein. The table accessory may be positionable at multiple locations along the accessory retention slot. The accessory retention slot may define an undercut region configured to retain the table accessory to the table top.

The table system may further include an alignment strut positioned in the accessory retention slot and configured to engage with an alignment feature of the table accessory to inhibit motion of the table accessory within the accessory retention slot. The table accessory may be selected from the group consisting of a cup holder, a hook, a basket, a shelf, and a bottle.

A table system with an articulable leg system may include a table top, a set of four legs coupled to a bottom of the table top and configured to support the table top relative to a ground structure, each respective leg configured to gimbal relative to the table top independently of each other leg, each respective leg comprising a respective strut portion and a respective ball portion coupled to the respective strut portion, and a respective leg retention mechanism for each respective leg, each respective leg retention mechanism operable in an unlocked configuration in which a respective leg is movable relative to the table top and a locked configuration in which the respective leg is fixed relative to the table top. The ball portion and the strut portion may be a monolithic structure.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
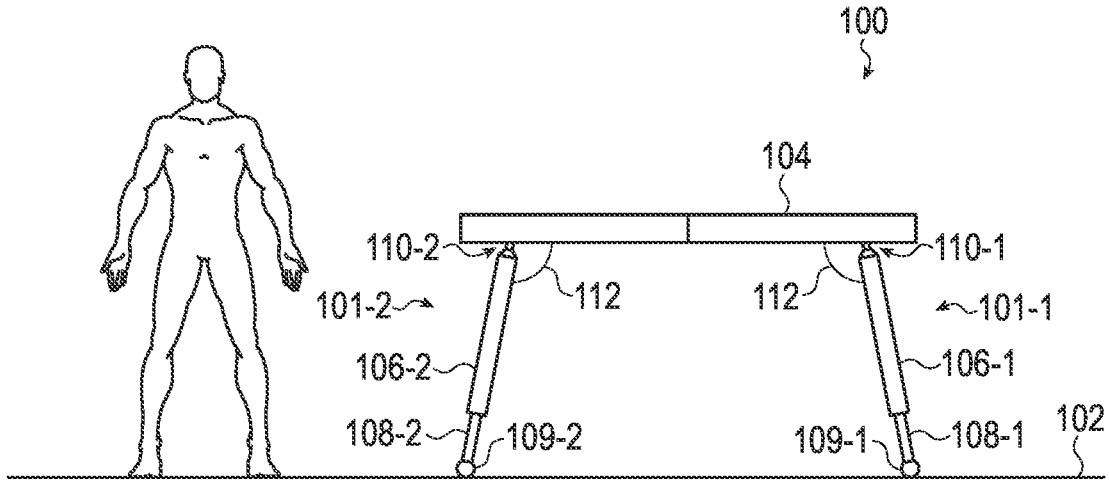
FIGS. 1A-1B depict an example table with an articulable leg system.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Portable outdoor furniture is often used to enhance the experience and convenience of outdoor recreation. For example, portable tables and chairs are often used for camping, tailgating, fishing, sporting events, and the like. However, the varied and inconsistent terrain often encountered during such events and applications can cause furniture to be unstable or uneven, and may limit the locations in which such furniture may be located. For example, a conventional four-legged table cannot generally be positioned in a level orientation on a slope or incline. Even if the ground is generally level (e.g., not on a hill or incline), even small deviations or obstacles on the ground surface, such as rocks, sticks, potholes, roots, stumps, divots, or the like, can cause a table to wobble or be otherwise unstable. Such drawbacks can limit the usefulness and effectiveness of outdoor furniture. These problems are especially apparent for tables, as non-level, wobbling, or otherwise unstable tabletops can lead to objects falling or rolling off the table, unexpected spills, and the like.

Described herein is a table with an articulable leg system, in which each individual leg of the table is adjustable in length and can be gimballed about a pivot point to enable a multitude of possible orientations. For example, the legs may each be attached to the table by a ball-and-socket joint (or other suitable mechanism that allows the table to be articulated about at least two rotational axes), such that each leg may be positioned at a unique angle from the table. Further, each leg may be telescopic so that the length of each leg can be individually selected. By allowing each leg to be adjusted independently of the others, both in length and in angle, a table as described herein can be adjusted so that the table top is level and the table is stable on just about any terrain, including hills, inclines, lawns, rocky or uneven surfaces, or the like.

As noted above, outdoor tables are used for myriad different recreational activities, each of which may use the table for different functions. For example, during a camping trip, a table may be used for preparing, serving, and eating meals. During a fishing trip, a table may be used for holding fishing gear, for cleaning and preparing fish, or the like. In order to improve the functionality of the table for various different applications and uses, also described herein is a table with a modular accessory system, in which numerous different accessories can be quickly and securely attached to (and detached from) the table. For example, a table may include an accessory retention feature, such as a specially configured slot, that engages corresponding features on accessories. Example accessories that may be removably coupled to the table via an accessory retention feature may include, without limitation, water bottles, utensil racks, beverage holders, storage shelves, accessory hooks, trays, trash cans, trash bag holders, and the like. Users may selectively attach accessories to the table, and the attachment features ensure that the accessories are conveniently positioned and securely attached. Further, the modular accessory system allows accessories to be securely mounted without the use of clamps or other mechanisms that may mar or damage the table, and which may be prone to loosening or providing insecure attachment to the table. These and other concepts are described herein.

Figure 1B:
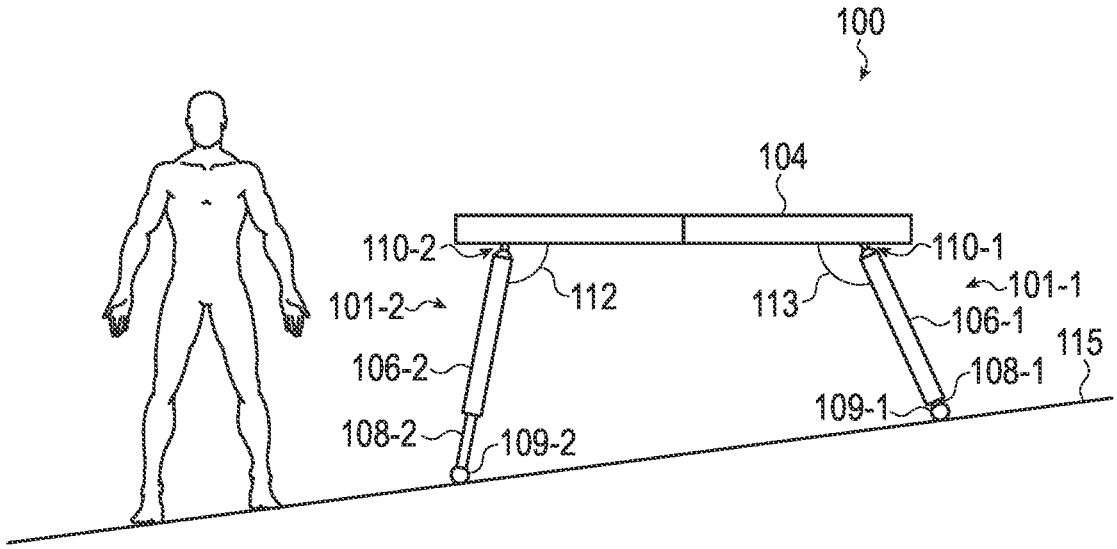

FIGS. 1A-1B illustrate an example table 100 with an articulable leg system, as described herein. The table 100 includes a table top 104 and a set of legs 101 (e.g., 101-1, . . . , **101-*n*) that are configured to support the table top 104 relative to a ground structure. The legs 101 may be articulatably coupled to the table top 104 via leg retention mechanisms 110 (e.g., 110-1, . . . , 110-4). As described herein, the leg retention mechanisms 110 may allow the legs 101 to articulate or gimbal, relative to the table top, about multiple angular degrees of freedom, such that it can extend from the table top 104 at a multitude of angles. Further, the leg retention mechanisms 110 may be operable in an unsecured (e.g., unlocked) configuration in which the leg can be easily positioned in a desired orientation, and a secured (e.g., locked) configuration in which the leg is secured in its desired orientation and supports the table top 104. Examples of leg retention mechanisms 110** that provide these and other functions are described herein.

The lengths of the legs 101 may also be adjustable in order to further customize the table legs to accommodate different terrains. For example, the legs may be telescoping (e.g., including an upper strut portion 106 and a lower strut portion 108) to facilitate length changes. Further, the legs 101 may include a foot portion 109 that may also be adjustable relative to the lower strut portion 108 (e.g., via a threaded coupling) to make fine adjustments to the length of the legs 101.

FIG. 1A illustrates the table on a first ground structure 102. As shown, the ground structure 102 is flat and level, and the legs 101 have a first orientation relative to the table top 104. In the example of FIG. 1A, the legs 101 are positioned at similar angles (e.g., angle 112) to the table top 104, and the table top 104 is level. FIG. 1B illustrates the table on a second ground structure 115, which is not level (e.g., it is inclined). In order to configure the table 100 so that the table top 104 is level, the legs 101 may be individually and independently adjusted so that all of the legs (e.g., all four legs, two of which are showing) contact the ground. In the example shown in FIG. 1B, a first leg 101-1 has been configured to have a different (e.g., shorter) length than the other leg 101-2, and is positioned at a different angle 113 relative to the table top 104. As described herein, the particular length and angle of the leg 101-1 may be selected by a user given the particular surface on which the table is being placed, the target height and angle of the table top, the manner in which the table is to be supported (e.g., if a particular leg angle provides additional stability in a particular direction), or the like. While FIG. 1B illustrates a featureless (e.g., flat) inclined ground structure, this is merely one example of an irregular ground structure that the table 100 may be effectively positioned on. For example, as described herein, the adjustable legs may support the table on other types of terrain as well (e.g., uneven terrain with obstacles, holes, roots, rocks, etc.).

Figure 2A:
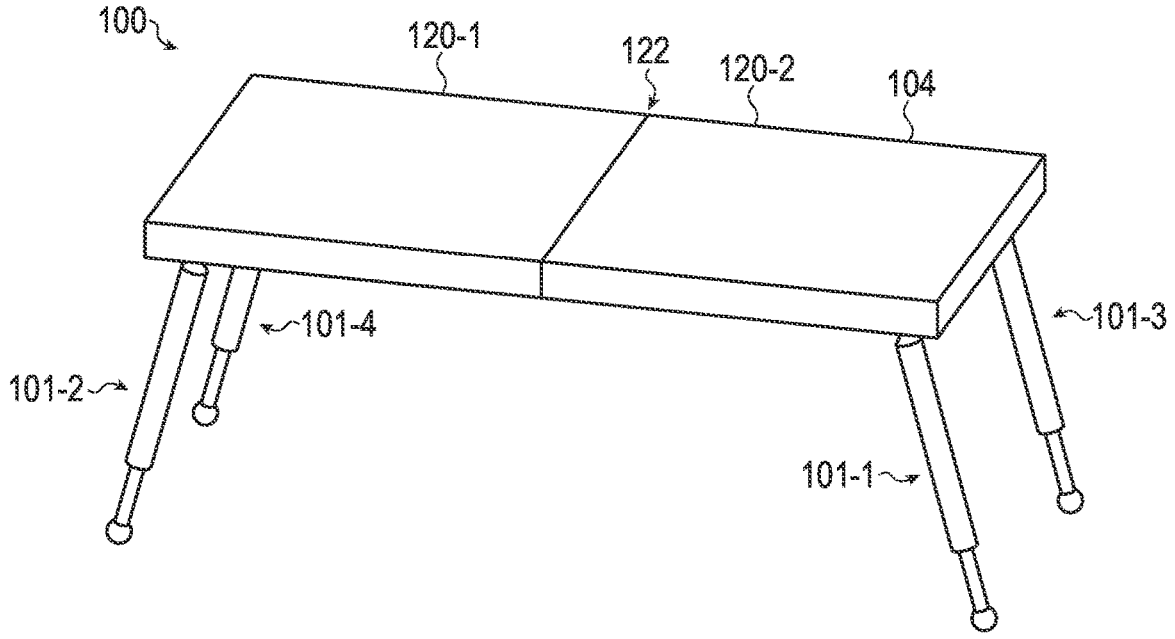
FIGS. 2A-2D depict an example table with an articulable leg system, with the legs in various orientations.

FIG. 2A is a perspective view of the table 100. As shown in FIG. 2A, the table 100 may be collapsible for ease of storage, transport, and the like. The table top 104 may be foldable along a partition 122. In some cases, the table top 104 may include multiple table top segments 120 (120-1, 120-2), which may be coupled together via one or more hinges or other articulating mechanisms (e.g., hinges 202, FIG. 2B).

Figure 2B:
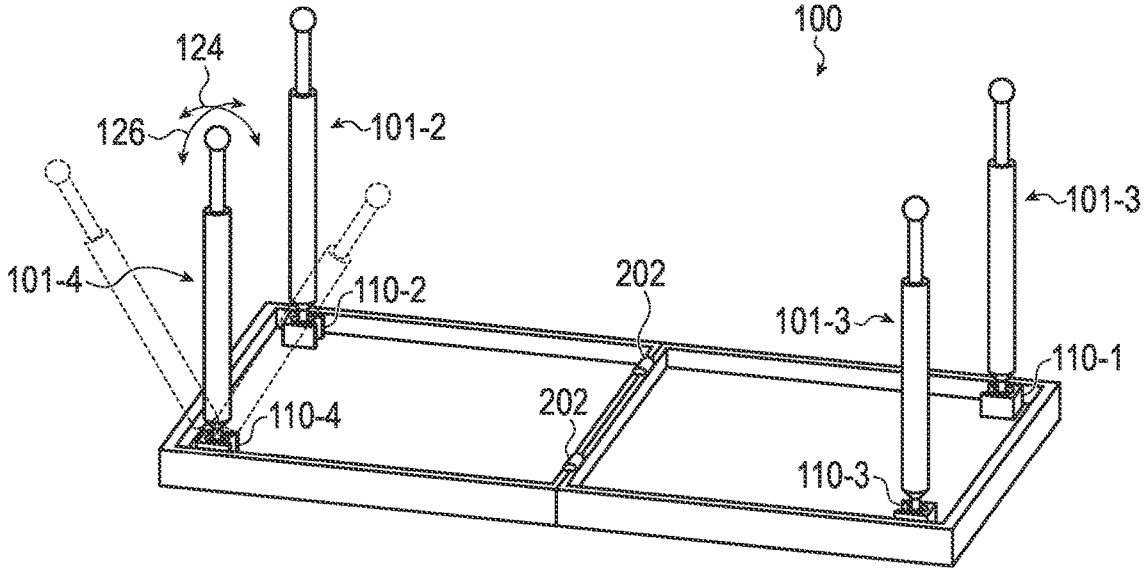
Figure 2C:
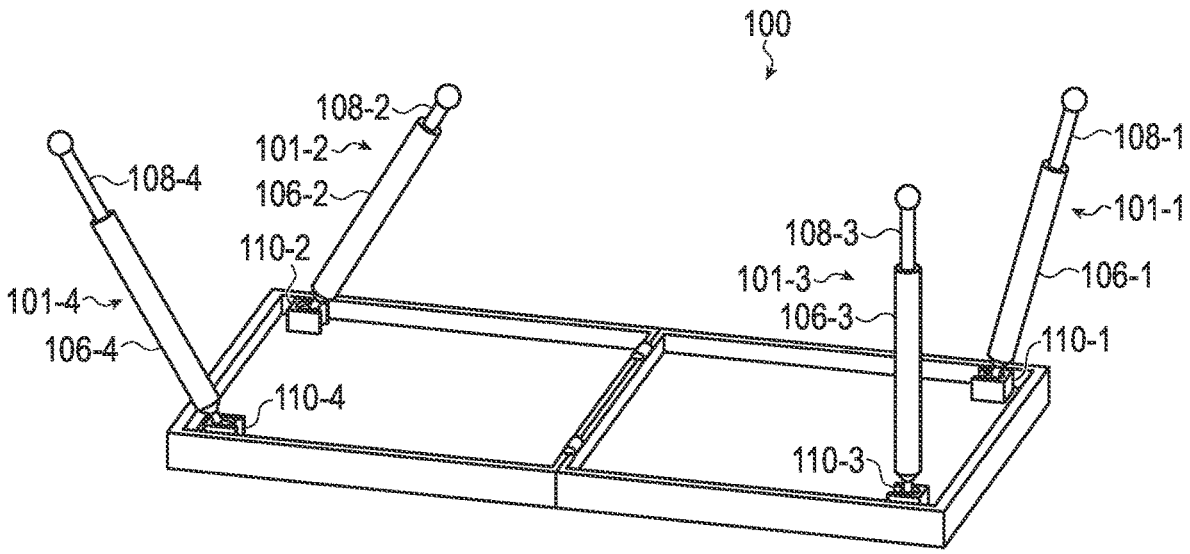

As described above, the legs of the table 100 may be movable, relative to the table top, about at least two angular degrees of freedom. FIG. 2B is a perspective view of the underside of the table 100, illustrating how the legs may be moved or gimballed relative to the table top. In particular, the leg 101-4 may be movable about a first angular degree of freedom, as indicated by arrow 124, and a second angular degree of freedom, as indicated by arrow 126. Because the legs can move about two angular degrees of freedom, the legs are not limited to movement in a single plane or along a single arc. Rather, the legs may be positioned at nearly any angle, relative to the table top 104, within the physical constraints of the leg retention mechanisms 110. Further, each leg 101 may be independently movable in the same manner, such that each leg can project from the table top 104 at a different angle. FIG. 2C illustrates the table 100 with each leg positioned at a different angle relative to the table top 104. As described, the ability to independently adjust the angle of each leg, and the fact that each leg can gimbal about its base (e.g., articulate or move about two angular degrees of freedom) allows the table to be supported in a stable, level orientation on many different terrains and environments.

As described herein, the movement of the legs about the two angular degrees of freedom is facilitated by a ball-and-socket style joint (also referred to as a ball joint) that couples the legs to the table top. For example, each leg may have a ball portion, and each leg retention mechanism 110 may have a socket that receives the ball portion therein. The leg retention mechanism 110 can be unlocked (e.g., an unsecured configuration) in which the leg is movable relative to the table top, and locked (e.g., a secured configuration) so that the leg is fixed relative to the table top.

Further, the length of each leg 101 may be independently adjustable, such as via a telescoping mechanism. FIG. 2C also illustrates the legs 101-2 and 101-4 positioned at different lengths. For example, the upper and lower strut portions 106, 108 may be adjusted relative to one another and secured at a desired length. The ability to independently adjust the length of each leg further expands the terrain and environments in which the table 100 may be successfully deployed.

Figure 2D:
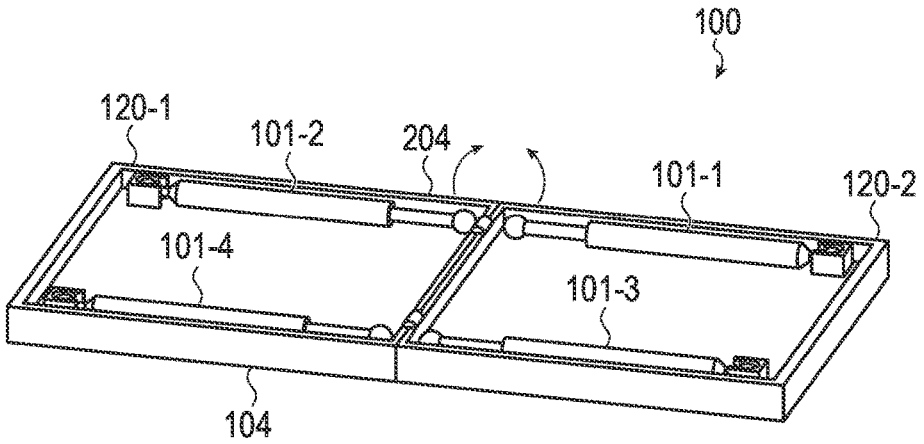

The legs 101 may also be stowable along the bottom of the table top 104 to allow the table 100 to be folded for storage and transport. FIG. 2D illustrates the table 100 with the legs 101 stowed. The legs 101 and the leg retention mechanisms 110 may be configured such that when the legs 101 are in the stowed position, the legs 101 and the leg retention mechanisms 110 are flush with or recessed relative to a flange portion 204 of the table top 104, or are otherwise configured so that they do not interfere with the folding of the table 100.

Figure 3:
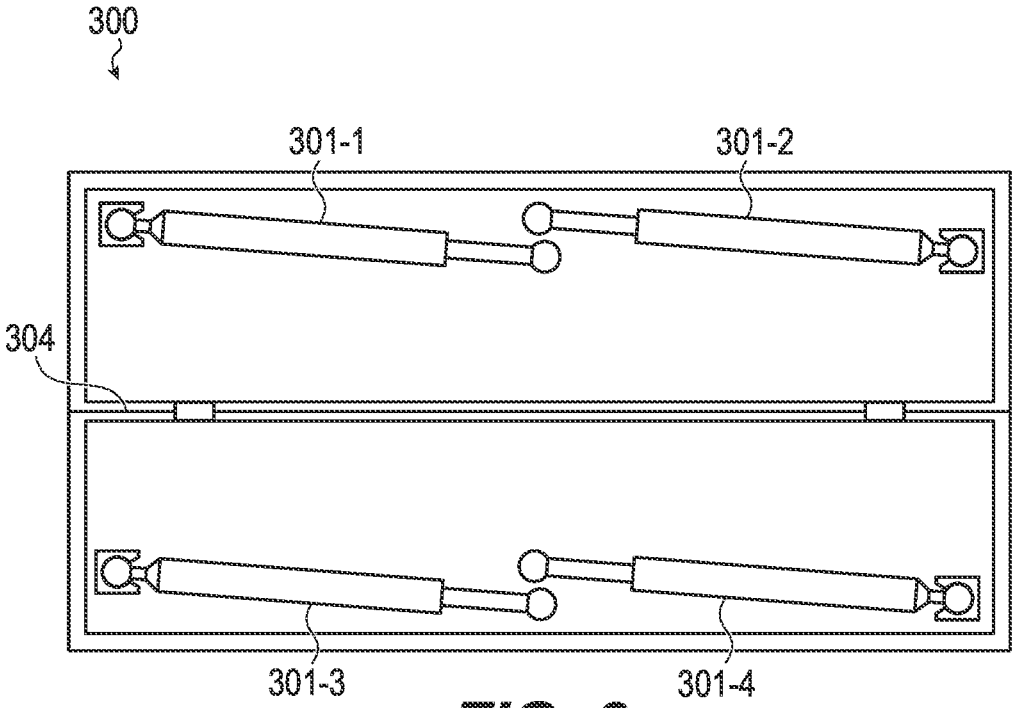
FIG. 3 depicts another example table with an articulable leg system.

While the table 100 is shown as being foldable along a partition 122 that extends along a width direction of the table 100, this is merely one example configuration for a table with an articulable leg system. For example, FIG. 3 illustrates a table 300 that includes articulable legs 301 (which may be embodiments of the legs 101) that is foldable along partition 304 that extends along a length of the table. In other examples, a table with articulable legs as described herein uses a non-foldable or fixed table top.

As described herein, the leg retention mechanisms may couple the legs of a table to a table top, and may be operable in an unsecured (e.g., unlocked) configuration in which the leg is movable relative to the table top, and a secured (e.g., locked) configuration in which the leg is fixed relative to the table top. FIGS. 4A-4F illustrate an example leg retention mechanism 400 that facilitates the leg articulations described herein. The leg retention mechanism 400 includes a base portion 401, which is configured to be fixedly coupled to the table top (e.g., the table top 104). For example, the base portion 401 may be coupled to the table top via any one or combination of fasteners (e.g., screws, bolts, etc.), adhesive, interlocking physical features, or the like. In some cases, the base portion 401 may be unitary with the table top (e.g., the table top and the base portion 401 may be molded or formed as a monolithic piece of material, such as molded plastic, machined metal, or the like).

The leg retention mechanism 400 also includes an articulating portion 403 that is coupled to the base portion 401 and is configured to articulate relative to the base portion 401. For example, the articulating portion 403 may be coupled to the base portion 401 via a flexible coupling 412, which may be a hinge, a living hinge, or the like. The base portion 401 may define a first portion of a socket 406, and the articulating portion 403 may define a second portion of the socket 406. As shown, the socket 406 may be a spherical socket that receives the ball portion 408 of a leg 410 therein.

The leg retention mechanism 400 also includes a latch mechanism 404. The latch mechanism 404 is configured to releasably secure the articulating portion 403 and the base portion 401. For example, in a first mode of operation (e.g., a secured or locked configuration), the latch mechanism 404 may secure the leg retention mechanism 400 in a closed configuration, such that the socket 406 imparts a retention force on the ball portion 408 of the leg 410. In this configuration, the ball portion 408 may be retained in a fixed orientation within the socket 406, such that the leg 410 is fixed relative to the table top and can support the table on a ground structure. In a second mode of operation (e.g., an unsecured or unlocked configuration), the latch mechanism 404 may allow the articulating portion 403 to move relative to the base portion 401, such that the socket 406 is at least partially opened and the ball portion 408 can move within the socket 406 to allow the leg 410 to be repositioned.

Figure 4A:
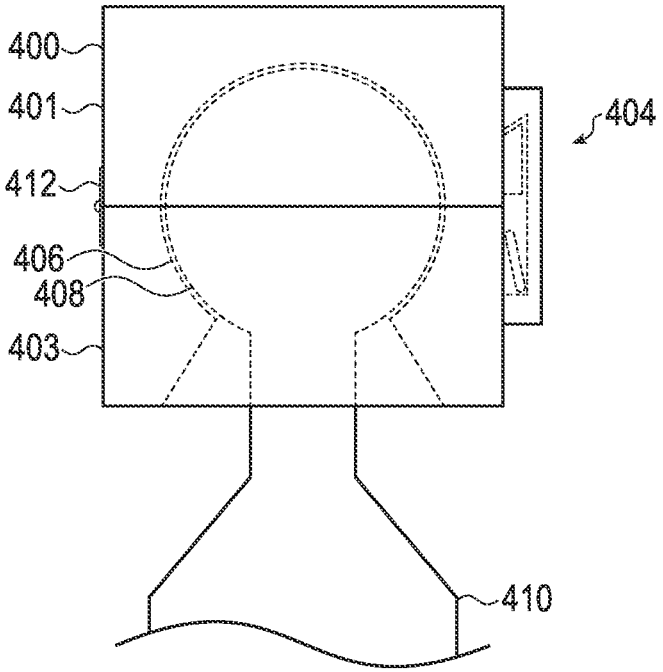
FIGS. 4A-4F depict an example leg retention mechanism for an articulable leg system.

FIGS. 4A-4D illustrate how the leg retention mechanism 400 can be locked and unlocked to facilitate a leg repositioning operation. For example, FIG. 4A illustrates the leg retention mechanism 400 in a secured configuration. In this configuration, the latch mechanism 404 is in a latched configuration, which secures the base portion 401 of the leg retention mechanism 400 to the articulating portion 403, and causes the surface of the socket 406 to be forced against the surface of the ball portion 408. The contact between the ball and socket surfaces in the secured state results in a retention force on the ball portion 408 that tends to prevent or inhibit motion of the ball portion 408 within the socket 406. For example, friction between the surface of the socket 406 and the surface of the ball portion 408 prevents or inhibits the ball portion 408 from sliding along the surface of the socket 406 and thus prevents or inhibits motion of the leg 410 relative to the table top. In some cases, as described herein, the socket 406 and the ball portion 408 include materials, features, and/or mechanisms that contribute to the retention force or the overall strength of the ball-to-socket interface when the leg retention mechanism is in the locked or secured configuration.

Figure 4B:
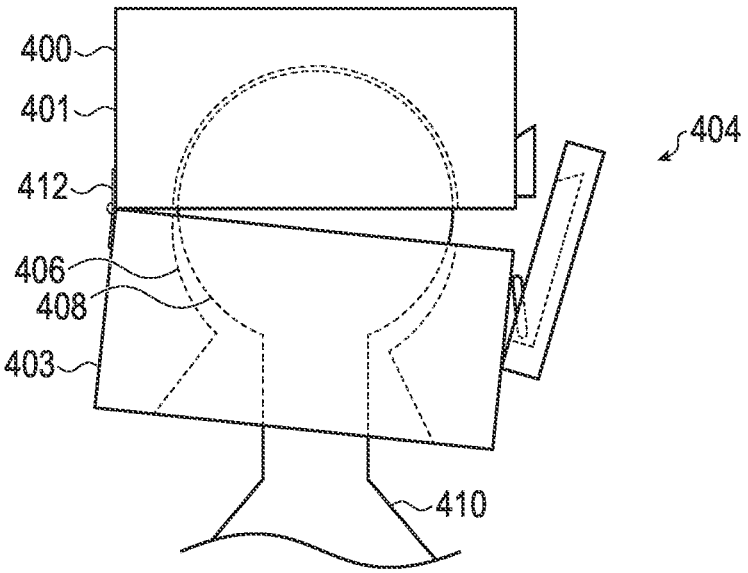

FIG. 4B illustrates the leg retention mechanism 400 in an unlocked or unsecured configuration. For example, the latch mechanism 404 is in an unlatched or open configuration, which allows the articulating portion 403 of the leg retention mechanism 400 to be articulated or moved (e.g., about the flexible coupling 412), thereby opening the socket 406 and releasing the retention force on the ball portion 408. The leg 410 is now movable relative to the table top. As described herein, the generally spherical shapes of the ball and socket joint facilitate the articulation of the leg 410 about multiple rotational axes, such that the leg 410 may gimbal relative to the table top (e.g., rather than being movable only along a path in a single plane or other fixed or constrained path).

Figure 4C:
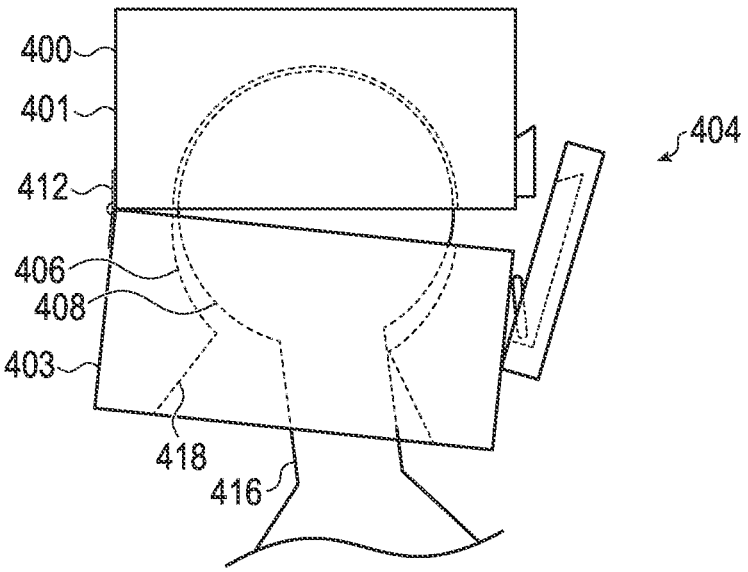

FIG. 4C illustrates the leg retention mechanism 400 in the unlocked or unsecured configuration, after the leg 410 has been moved to a different position, in which the leg 410 extends from the leg retention mechanism 400 (and thus a table top) at a different angle as compared to FIGS. 4A-4B. In some cases, the leg retention mechanism defines an opening 418 through which the leg 410 extends. The surface of the opening 418 may interact with a neck portion 416 of the leg 410 to define an articulation envelope for the leg 410 (e.g., the shape and size of the opening 418 and the neck portion 416 may serve to limit the extent of movement of the leg 410 relative to the table top). In some cases, the opening 418 may define a frustoconical surface. The frustoconical surface may be configured to provide a wide range of leg orientations relative to a table top. In some cases, the angle of the frustoconical surface of the opening 418 is between about 30 degrees and about 150 degrees. In some cases, the angle is between about 45 degrees and about 120 degrees.

Figure 4D:
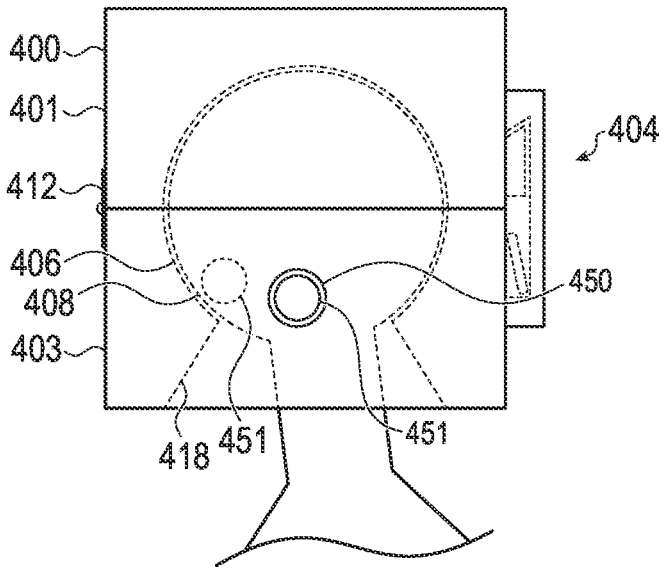

FIG. 4D illustrates the leg retention mechanism 400 in the locked or secured configuration, after the leg 410 has been moved from its position shown in FIG. 4A and after the leg retention mechanism 400 has been re-secured to retain the leg 410 in the user-established orientation. As described herein, friction between the ball portion 408 and the socket 406 may inhibit motion of the ball portion 408, thereby retaining the leg 410 in the user-established orientation.

In some cases, the leg retention mechanism 400 and the leg may include alignment graphics in order to aid in orienting the legs at particular orientations. For example, as shown in FIG. 4D, the leg retention mechanism 400 may include a hole 450 or opening that allows visual access to the ball portion of the leg, and the ball portion may include one or more marks 451 (e.g., painted dots, machined markings, etc.) that, when aligned within the hole 450 in the leg retention mechanism 400, correspond to a particular leg orientation. In this way, a user can easily and quickly position a leg in a desired orientation. Multiple (optionally color-coded) marks 451 may be provided to correspond to multiple common leg orientations, such as a stowed orientation, a "level ground" leg deployment orientation, a "high-stability" orientation, and the like. In some cases, users may add user-specific or custom markings to the ball portions to correspond to preferred user-established orientations, such as with ink, paint, stickers, or the like. Other alignment systems may be used instead of or in addition to the holes and marks described above, such as hash marks provided on the leg and the leg retention mechanism, or the like.

Figure 4E:
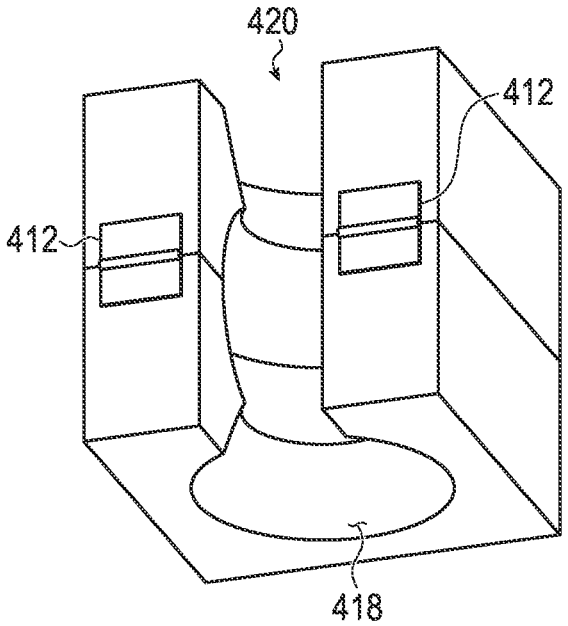

As described above, the legs of a table may be stowable so that the table can be folded or otherwise collapsed. The leg retention mechanism 400 may therefore include an opening 420 along a side of the leg retention mechanism 400 to allow the leg 410 to be moved into an orientation that is generally parallel to the table top (e.g., as shown in FIGS. 2D and 3). In some cases, the opening 420 is positioned on the side of the leg retention mechanism 400 that includes the flexible couplings 412, as shown in FIG. 4E. For example, the opening 420 may be positioned between two hinges that flexibly couple the articulating portion 403 to the base portion 401.

Figure 4F:
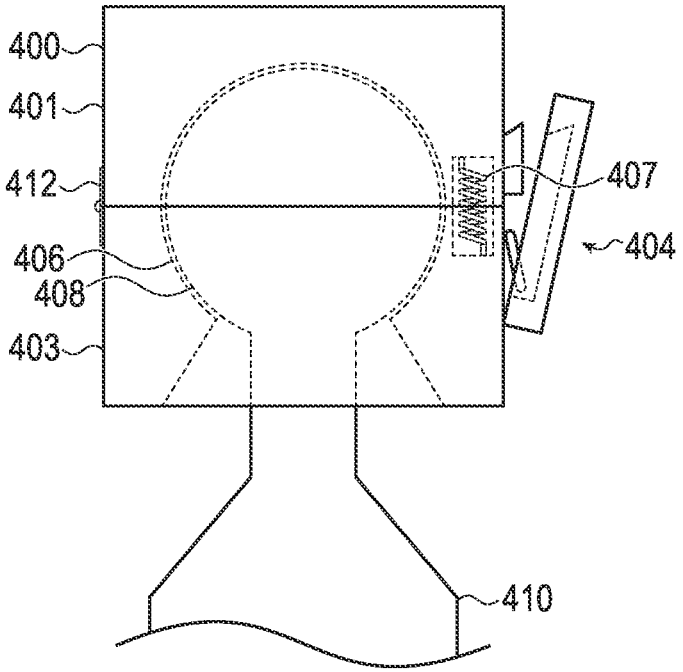

FIG. 4F illustrates an example of the leg retention mechanism 400 that includes a biasing spring 407. The biasing spring 407 biases the leg retention mechanism 400 in a closed configuration. The biasing spring 407 may have spring properties (e.g., spring rate, length, etc.) that cause the base and articulating portions 401, 403 to remain in a closed configuration even when the latch mechanism 404 is in an unlatched state. This may prevent or inhibit the articulating portion 403 from swinging freely when the latch mechanism 404 is unlatched, which may cause the leg and the leg retention mechanism to become unwieldy.

In some cases, the biasing spring 407 also maintains a force on the ball portion 408 when the latch mechanism 404 is unlatched. This force may cause the leg 410 to maintain an articulation preload that must be overcome in order to articulate the leg into different orientations. The preload may be sufficiently low that a user can easily overcome the preload and position the leg 410 in a user-established orientation (e.g., by moving the leg with their hand), but sufficiently high that (at least in some orientations), the legs tend not to fall or swing freely when unlatched. Thus, for example, when a user unlatches the latch mechanism 404 to adjust the legs 410, the legs 410 may remain stationary until the user moves them with their hands. In some cases, the preload is configured so that if the table is in a horizontal orientation when the latch mechanism 404 is unlatched, the force of gravity acting on the stowed legs is sufficient to overcome the preload force and move the legs to or proximate a perpendicular (e.g., deployed) orientation. From there, the user may further adjust the legs into the desired orientation, and latch the latch mechanism 404 to secure the legs. The spring parameters may be selected based at least in part on the friction between the ball portion 408 and the surface of the socket 406. For example, a spring with a higher spring force may be used when the ball portion 408 and the socket 406 have relatively lower friction, and a spring with a lower spring force may be used when the ball portion 408 and the socket 406 have a relatively higher friction. The biasing spring 407 may be used with other leg retention mechanisms shown and described herein.

FIGS. 5A-5D illustrate an example table 500 with a remote release mechanism for its leg retention mechanisms 502. For example, as described herein, the table 500 may include a user-actuatable lever 504 that can selectively lock and unlock a pair of leg retention mechanisms 502 to facilitate rapid deployment and stowage of the legs.

Figure 5A:
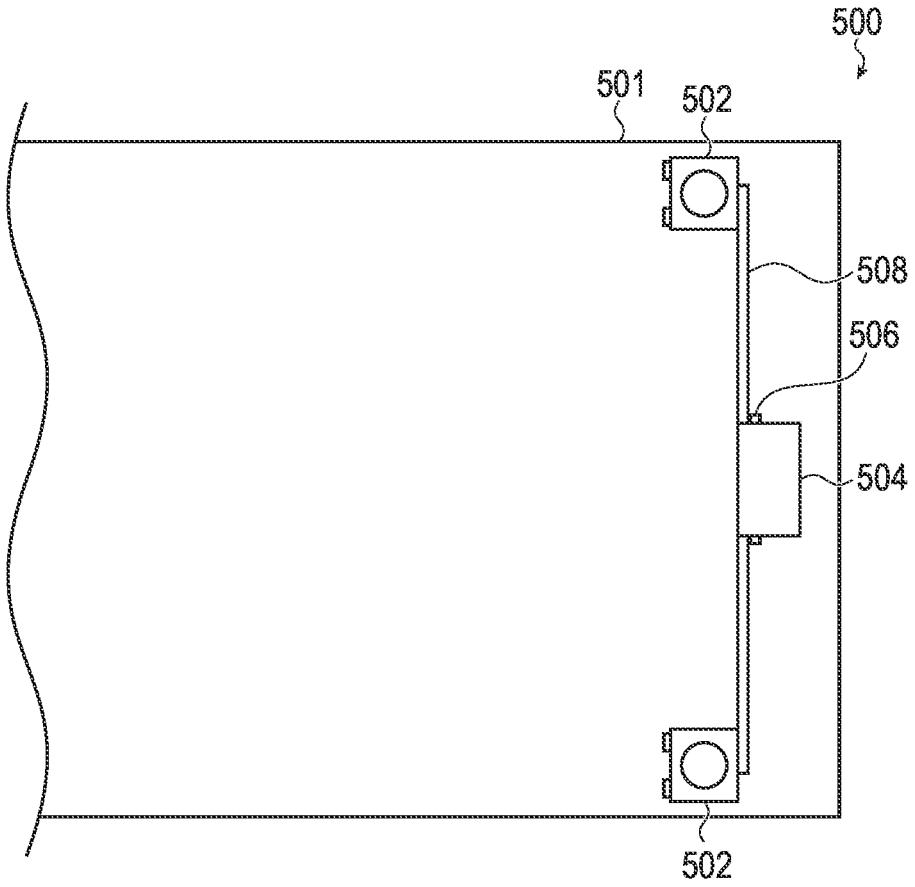
FIGS. 5A-5D depict an example table with a remote release mechanism for the leg retention mechanisms.

As shown in FIG. 5A, the remote release mechanism may include a user-actuatable lever 504 and an actuation arm 508. The user-actuatable lever 504 may be pivotally coupled to the table top 501 along a bottom side of the table top 501, such as via pivot 506. The user-actuatable lever 504 may be positioned proximate a side of the table top 501, such that a user can conveniently access the lever 504 when gripping the table from the top side. For example, when grasping the side of the table 500, the user's fingers may be positioned conveniently on the user-actuatable lever 504, such that they can easily squeeze the lever 504 to unlock the leg retention mechanisms.

Figure 5B:
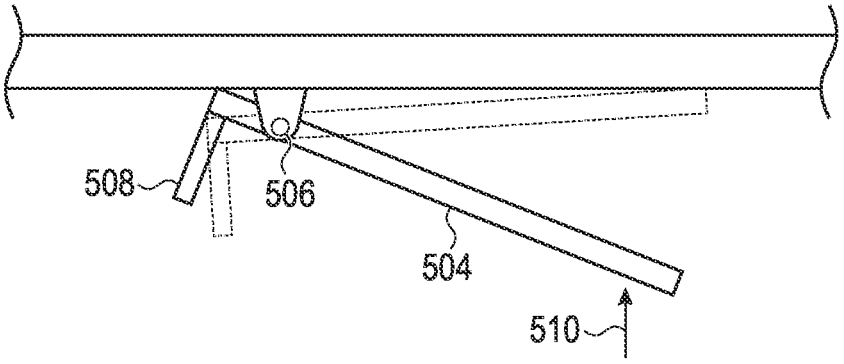
Figure 5C:
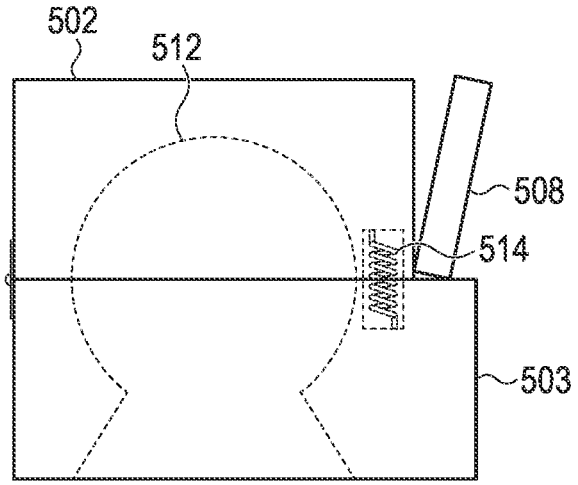
Figure 5D:
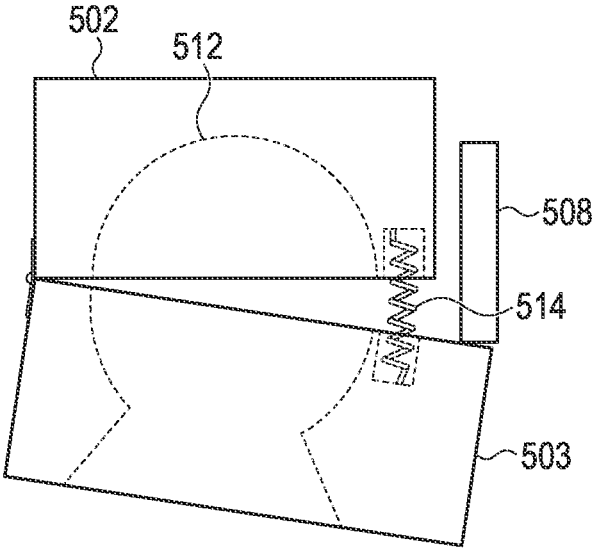

FIG. 5B illustrates the lever 504 in an un-depressed or un-actuated state (solid lines), and in a depressed or actuated state (broken lines). In particular, when a user applies an actuation force 510 to the lever 504, the lever pivots about the pivot 506, which causes the actuation arm 508 to move. The actuation arm 508 extends from the lever 504 and engages articulating portions 503 of the leg retention mechanisms 502 to move the articulating portions 503 from a locked to an unlocked configuration, as shown in FIGS. 5C-5D. In particular, FIG. 5C illustrates a leg retention mechanism 502 in a locked configuration, in which the actuation arm 508 is in an unactuated position (e.g., corresponding to the lever 504 not being actuated or depressed by a user). In this configuration, a biasing spring 514 may retain the leg retention mechanism 502 in the locked configuration, which ultimately retains a leg in its current orientation. The biasing spring 514 may have sufficient biasing force to retain the leg in a user-established orientation during use of the table. In some cases, the leg retention mechanisms 502 may include a supplemental latch mechanism or other locking mechanism or system to increase the security of the leg retention mechanisms (e.g., to increase the locking or retention force on the ball portion of the legs. For example, the leg retention mechanisms 502 may include a latch mechanism 404, a pin retention mechanism (e.g., FIGS. 8A-8C), an interlocking protrusion/recess configuration (e.g., FIGS. 9A-9D), or the like.

FIGS. 5C-5D illustrate how the actuation arm 508 may selectively unlock and lock the leg retention mechanism in an example implementation. For example, as shown in FIG. 5C, the actuation arm 508 is in an unactuated state, corresponding to the lever 504 not being depressed or actuated. In this configuration, the biasing spring 514 retains the articulating portion 503 of the leg retention mechanism 502 in a locked or closed configuration, thereby preventing or inhibiting a leg from moving (e.g., the socket 512 may press against the ball portion of a leg). The force of the biasing spring 514 (as well as the other biasing spring on the other leg retention mechanism actuated by the actuation arm 508) may also bias the actuation arm 508, and thus the lever 504, in the unactuated state. When the lever 504 is depressed, the actuation arm 508 applies a force to the articulating portion 503 that overcomes the force of the biasing spring 514 and forces the articulating portion 503 into an unlocked state, in which the leg is articulatable into a user-established orientation (e.g., the socket 512 may be at least partially opened). As illustrated, the articulating portion 503 opened significantly in the unlocked state, though this is merely for illustration, and the articulating portion 503 need not open as far in all implementations. For example, in some cases, the articulating portion 503 remains substantially closed and in contact with the ball portion of a leg even when the articulating portion 503 is in the unlocked state, such that a preload force remains on the leg to prevent or inhibit free, unrestrained movement of the leg.

The particular configuration of the components shown in FIGS. 5A-5D are examples, and other configurations are also contemplated. For example, FIGS. 5C-5D illustrate an example leg retention mechanism in which the articulating portion 503 defines an overhang, and the actuation arm 508 contacts the overhang and slides along the overhang during actuation of the actuation arm 508. In other examples, the actuation arm 508 may be secured to the articulating portion 503 with a pivoting joint or other type of joint structure. In some cases, the lever 504 may be coupled to the leg retention mechanisms via a cable system (e.g., a cable routed through a cable housing). In such cases, the lever 504 and the leg retention mechanisms 502 may have cable attachment components (e.g., cable clamps, cable guides, cable housing ferrules, etc.) and/or other mechanisms (e.g., pivoting levers) to cause the articulating portion 503 to move between the locked and unlocked states when the lever 504 is actuated.

In some cases, a table includes two remote release mechanisms, with each remote release mechanism operating two leg retention mechanisms. In other cases, a single remote release mechanism operates four leg retention mechanisms.

Figure 6A:
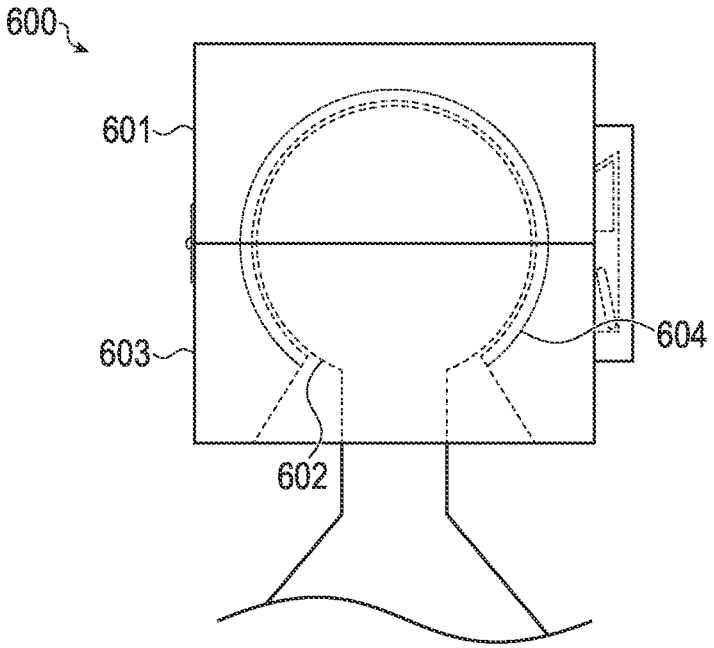
FIGS. 6A-6B depict other example leg retention mechanisms for an articulable leg system.

As described herein, leg retention mechanisms are configured to both allow free movement of a leg (within an articulation envelope) when the leg retention mechanism is in an unlocked or unsecured configuration, and to securely retain the leg in a user-established orientation when the leg retention mechanism is in a locked or secured configuration. For example, the leg retention mechanism may impart a retention force to the leg (e.g., on the surface of a ball portion of the leg) to retain the leg in the user-established orientation. In some cases, one or both of the socket and the ball portion may include a lining or covering to provide a sufficient friction to retain the leg in the user-established orientation during use of the table. For example, FIG. 6A illustrates an example leg retention mechanism 600 with a lining 604. The lining 604 (e.g., a slip-resistant lining) may be formed from a polymer material such as an elastomer, rubber, foam, or the like. In some cases, the lining 604 produces a greater retention force (e.g., friction force) on a ball portion 602 as compared to an unlined leg retention mechanism. For example, the body of the leg retention mechanism (e.g., the base portion 601 and articulating portion 603 of a leg retention mechanism) may be formed from a different material than the lining, and the coefficient of friction between the body of the leg retention mechanism and the ball portion 602 may be lower than the coefficient of friction between the lining and the ball portion 602. The body of the leg retention mechanism 600 may be formed from any suitable material(s), such as metal (e.g., steel, aluminum, metal alloys, etc.), polymers (e.g., polyethylene, acrylonitrile butadiene styrene, etc.), composites (e.g., fiber-reinforced polymers, metal matrix composites, etc.), or the like.

In some cases, the lining 604 may be configured to deform when the leg retention mechanism 600 is in the locked or secured configuration. For example, a foam or compliant polymer material may be deformed or compressed when the leg retention mechanism 600 is locked. The deformation of the lining 604 may help force the lining 604 into intimate contact with the ball portion 602, and may help maximize or otherwise improve the contact area between the lining 604 and the ball portion 602.

The materials of the body and the lining of the leg retention mechanism 600 may be selected to provide different properties to the leg retention mechanism 600. For example, in order to provide a high degree of clamping force on the ball portion, the body of the leg retention mechanism may be formed from material(s) that are stiff and tough and will not significantly deform or deflect when latched or otherwise secured. By using a lining 604, the material of the body may be selected based on its strength, stiffness, toughness, and/or other structural properties, and without regard to the coefficient of friction between the body material and the material of the ball portion 602. The lining 604 may be coupled to the body of the leg retention mechanism 600 in various ways. For example, the lining 604 may be a coating that bonds directly to the body, such as a paint, epoxy, curable polymer, or the like. As another example, the lining 604 may be adhered to the body of the leg retention mechanism and/or attached via fasteners, interlocking features, or the like.

Figure 6B:
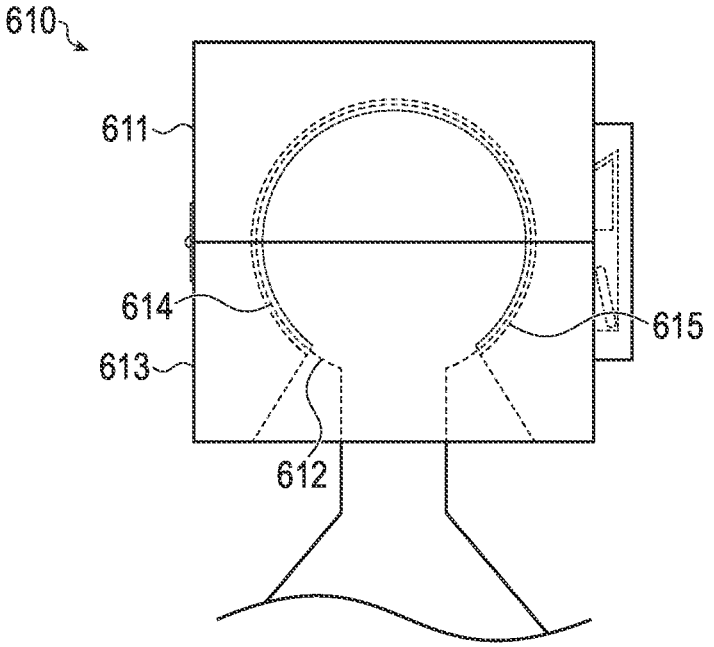

FIG. 6B illustrates a leg retention mechanism 610 with a lining 614 attached to the ball portion 612. The lining 614 may be the same as or similar to the lining 604 in structure, material, and function, but instead of being integrated with the leg retention mechanism 610, it is integrated with the ball portion 612 of the leg. For example, the lining 614 may be a polymer shell that at least partially surrounds the ball portion 612 to improve the retention force (e.g., the coefficient of friction) between the ball portion 612 and the socket 615. In some cases, the ball portion 612 may define a recessed surface on which the lining 614 may be positioned (such that the exterior surface of the lining 614 may be flush with an adjacent portion of the exposed ball portion 612). FIG. 6B illustrates the ball portion 612 having a lining 614 thereon, and a base portion 611 and an articulating portion 613 of the leg retention mechanism 610 having no lining thereon. In some cases, however, both the body of a leg retention mechanism (as shown in FIG. 6A) and the ball portion (as shown in FIG. 6B) have linings thereon.

In some cases, multiple segments or pads of a lining material are provided on the ball portion and/or socket. In such cases, an air gap may be formed between the surface of the ball portion and the surface of the socket in areas that lack the lining pads.

Figure 7:
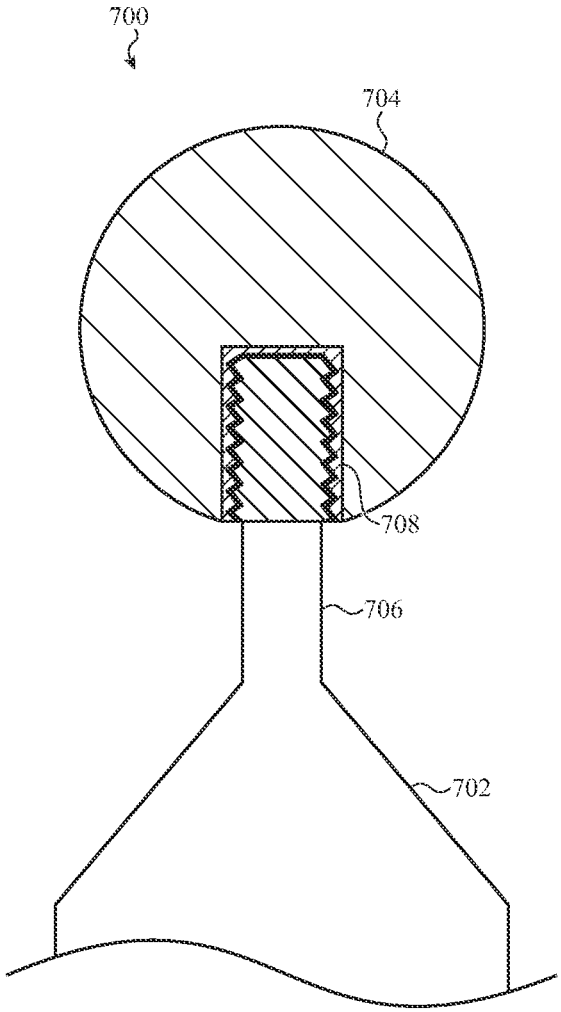
FIG. 7 depicts a portion of an example leg for an articulable leg system.

In some cases, the ball portion of a leg may be part of a unitary structure that defines a strut portion and the ball portion of a leg. For example, a single piece of metal or polymer (e.g., fiber-reinforced polymer) may define both an upper strut portion of a leg and the ball portion of the leg. FIGS. 4A-4D, for example, illustrate a leg with a unitary structure defining an upper strut and ball portion of the leg. FIG. 7 illustrates an example leg 700 in which the ball portion 704 is a separate structure from a strut 702 of the leg 700. In this example, the ball portion is attached to the strut 702 via a threaded interface. For example, the ball portion 704 includes a threaded hole, and a threaded post 706 of the leg 700 engages the threaded hole.

The threaded hole of the ball portion 704 may be defined by the same material as the rest of the ball portion 704. In some cases, a threaded sleeve 708 is positioned in the ball portion 704, and the threaded sleeve 708 receives the threaded post 706 therein. The threaded sleeve 708 may be formed from a different material than the ball portion 704. For example, the ball portion 704 may be formed from a polymer (e.g., a fiber-reinforced polymer), and the threaded sleeve 708 may be formed from metal (e.g., brass, steel, etc.). The ball portion 704 may be formed by insert molding, in which the threaded sleeve 708 is positioned in a mold cavity, and the material for the ball portion is introduced into the mold cavity to engage the threaded sleeve 708 and be shaped into the ball portion 704. In some cases, the threaded sleeve 708 defines engagement features such as splines, threads, protrusions, cavities, recesses, or the like, to facilitate engagement and retention between the threaded sleeve 708 and the ball portion 704.

FIG. 7 illustrates the ball portion having a threaded hole (e.g., the threaded sleeve 708) and the leg strut 702 having a threaded rod. In other examples, the components are reversed, such that the ball portion 704 may define a threaded rod or post that is engaged with a threaded hole in the strut 702 of a leg.

As described herein, a leg retention mechanism may use frictional forces to retain a ball portion of a leg in a user-established orientation. In some cases, the surfaces of the leg retention mechanism and the ball portion are substantially featureless surfaces. For example, a socket of a leg retention mechanism may have a smooth rubber lining, which engages a smooth exterior surface of a ball portion. In some cases, however, the ball and/or socket (and the leg retention mechanism more generally) may include features and/or mechanisms to retain the legs in a user-established orientation.

Figure 8A:
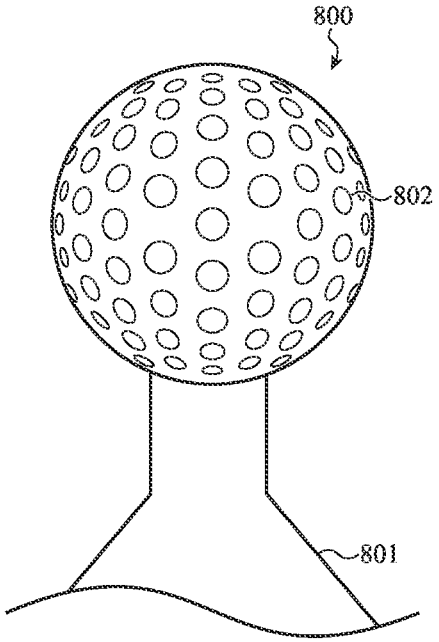
FIGS. 8A-8C depict another example leg retention mechanism for an articulable leg system.
Figure 8B:
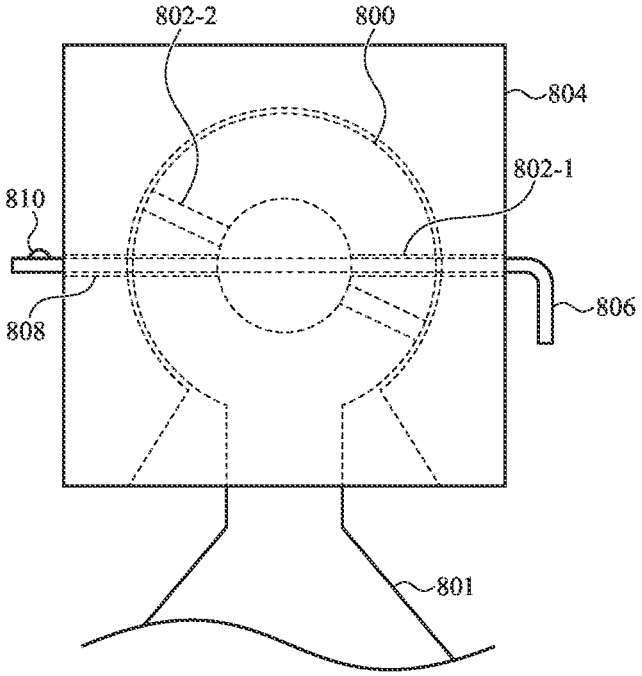
Figure 8C:
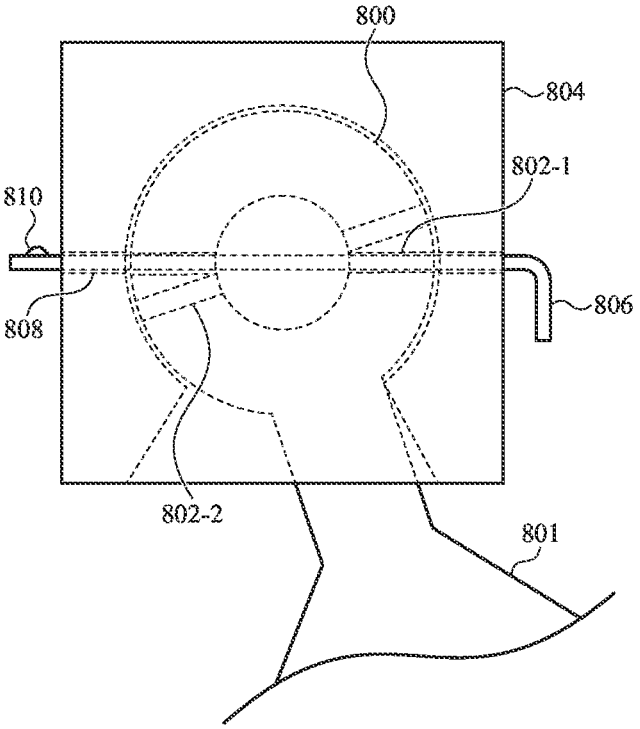

FIGS. 8A-8C illustrate an example in which a retention pin is used to retain a leg 801 in a user-established orientation. For example, FIG. 8A illustrates a ball portion 800 with a plurality of through-holes 802 defined therethrough. A corresponding leg retention mechanism 804 (FIG. 8B) may define a guide hole 808, and a pin 806 may be inserted through the guide hole 808 and through one of the through-holes 802 through the ball portion 800 to retain (e.g., lock) the ball portion 800 in a fixed position in the socket of the leg retention mechanism 804. Thus, to adjust the orientation of a leg, the pin 806 may be removed from the ball portion 800 such that the ball portion 800 can move within the leg retention mechanism. Once the leg is in a desired orientation, the pin 806 can be inserted through a through-hole 802 that is proximate the guide hole 808 to fix the leg in the user-established orientation. FIG. 8B illustrates the leg 801 in a first orientation, in which the pin 806 extends through a first through-hole 802-1 of the ball portion 800, while FIG. 8C illustrates the leg 801 in a second orientation, in which the pin 806 extends through a second through-hole 802-2 of the ball portion 800.

For simplicity, FIGS. 8B-8C illustrate only two through-holes 802, though it will be understood that the ball portion 800 may include many more through-holes. In some cases, the ball portion 800 includes more than 10 through-holes, more than 20 through-holes, more than 30 through-holes, more than 40 through-holes, or any other suitable amount of through-holes. As used herein, a through-hole may include or be defined by two openings in the surface of the ball portion. Thus, for example, a ball portion having 10 through-holes will have 20 openings along its outer surfaces (e.g., each through-hole will have an "entry" opening and an "exit" opening along the exterior surface of the ball portion). The through-holes 802 may be distributed in a regular or irregular pattern around the circumference of the ball portion 800, and may be sufficiently numerous to provide a suitably small adjustment pitch (e.g., the distance or angle between two adjacent through-holes) to facilitate precise positioning of the leg.

The pin 806 may include a spring detent 810 to inhibit accidental or unwanted removal of the pin 806 from the leg retention mechanism 804. In some cases, the pin 806 is captive to the leg retention mechanism 804, such that it cannot be completely removed from the body of the leg retention mechanism. In some cases, the pin 806 may be tethered to the leg retention mechanism and/or the table to prevent loss of the pin.

Figure 9A:
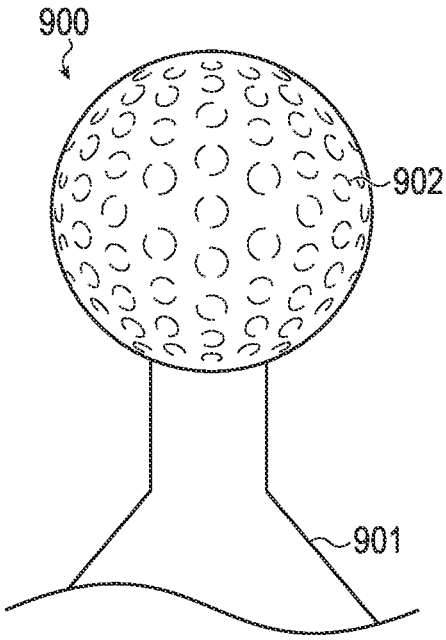
FIGS. 9A-9D depict another example leg retention mechanism for an articulable leg system.
Figure 9B:
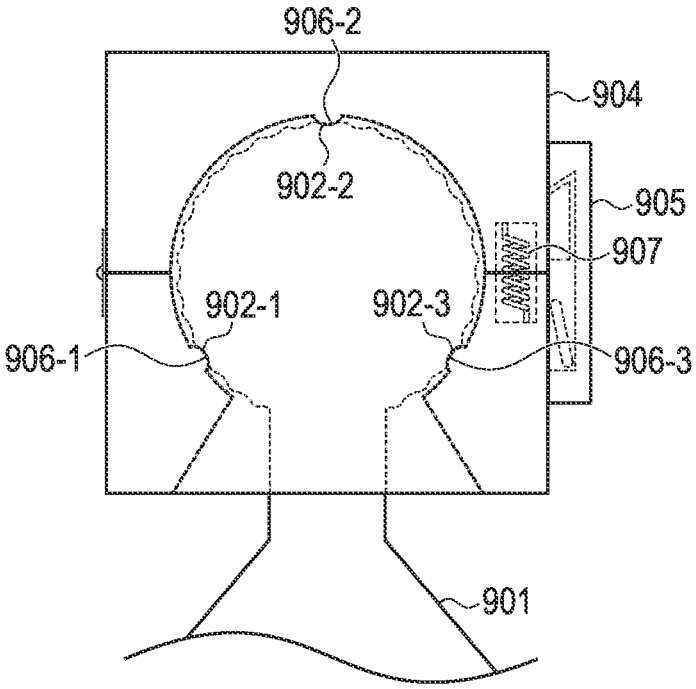
Figure 9C:
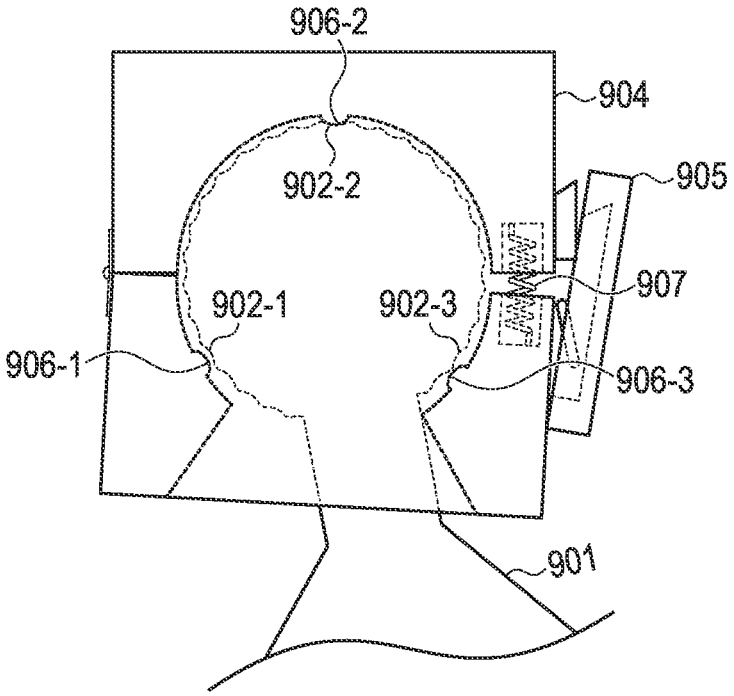
Figure 9D:
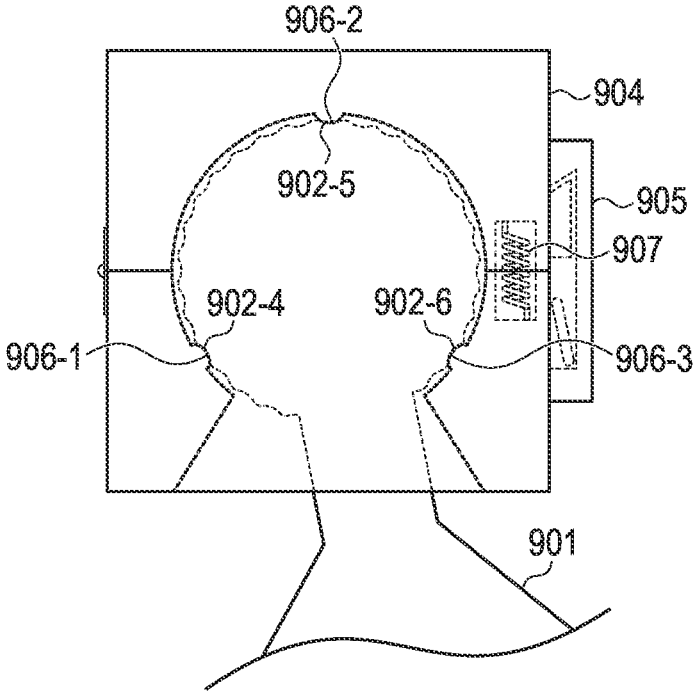

FIGS. 9A-9D illustrate an example in which interlocking protrusions and dimples are used to retain a leg 901 in a user-established orientation. For example, FIG. 9A illustrates a ball portion 900 with a plurality of dimples 902 defined along the exterior surface of the ball portion 900. A corresponding leg retention mechanism 904 (FIGS. 9B-9D) may define one or more protrusions 906 that are configured to extend into and/or otherwise engage the dimples 902. Thus, to adjust the orientation of a leg, the leg retention mechanism 904 may be manipulated into an unsecured configuration (e.g., by unlatching the latch mechanism 905) such that the ball portion 900 can move within the leg retention mechanism. Once the leg is in a desired orientation, the leg retention mechanism 904 can be closed and latched or otherwise secured, such that the protrusions 906 extend into or otherwise engage dimples 902 that are nearby the protrusions 906 when the leg is in that orientation. FIG. 9B illustrates the leg 901 in a first orientation, in which the leg is in a first orientation and the protrusions 906-1, 906-2, and 906-3 are engaged with dimples 902-1, 902-2, and 902-3, while FIG. 9D illustrates the leg 901 in a second orientation, in which the protrusions 906-1, 906-2, and 906-3 are engaged with dimples 902-4, 902-5, and 902-6. While FIGS. 9B-9D illustrate the leg retention mechanism 904 having three protrusions 906, more or fewer protrusions may be provided.

FIGS. 9B-9D also illustrate the leg retention mechanism 904 with an optional biasing spring 907. The biasing spring 907 operates in a manner similar to the biasing springs described herein (e.g., the biasing springs 407, 514), and it will be understood that the principles and details described with respect to those biasing springs are also applicable to the biasing spring 907. For example, FIG. 9C illustrates the leg retention mechanisms 904 in an unlatched configuration during a leg positioning operation. In this configuration, the biasing spring 907 has been overcome due to a user manually moving the leg while the latch mechanism 905 is unlatched, resulting in the articulating portion of the leg retention mechanism 904 opening slightly with respect to the base portion. As shown, the biasing spring 907 imparts a force on the articulating portion to bias it towards a closed configuration and provide a nominal frictional or resistive force to the ball portion 900 while the leg is being repositioned (e.g., to prevent or inhibit the leg from falling or swinging abruptly when the latch is unlatched).

Further, as described above, a ball and socket configuration with interlocking protrusions and dimples, as shown in FIGS. 9A-9D, may also be used with a remote release mechanism (instead of or in addition to the latch mechanism 905), as described above.

In some cases, the ball portion 900 includes more than 50 dimples, more than 75 dimples, more than 100 dimples, more than 200 dimples, or any other suitable amount of dimples. The dimples 902 may be distributed in a regular or irregular pattern around the circumference of the ball portion 900, and may be sufficiently numerous to provide a suitably small adjustment pitch (e.g., the distance or angle between two adjacent dimples) to facilitate precise positioning of the leg. Further, the dimples and the protrusions may be positioned according to regular patterns, such that multiple (in some cases all) respective protrusions can be simultaneously aligned with respective dimples.

The dimples 902 (and the protrusions) may have a partially spherical shape, or any other suitable, complementary shapes (e.g., parabolic, conical, etc.). In some cases, one or both of the protrusions 906 and/or the surface of the ball portion 900 may be formed from a compliant material or otherwise configured to deflect when the leg retention mechanism 904 is in a secured configuration. For example, the protrusions 906 may be formed from a compliant polymer material (e.g., vulcanized rubber), a spring detent, or the like. In some cases, not all protrusions are aligned with a corresponding dimple when the leg retention mechanism is in a secured configuration. For example, in the case where the protrusions 906 are compliant, in a given leg orientation, some of the protrusions may engage dimples, while others do not engage dimples (or only partially engage dimples) and are at least partially deflected or deformed by non-dimpled portions of the surface of the ball portion.

While the foregoing examples illustrate a ball-and-socket joint between the table top and the table legs to facilitate adjustability of the leg orientation, this is merely one example mechanism that may be used. In some cases, the legs may be attached to a table top with other types of articulating structures, including linkage mechanisms, heim joints, rod end bearings, universal joints, canfield joints, or the like.

In addition to being moveable about at least two angular degrees of freedom relative to a table top (e.g., gimballing), the legs of a table may also have adjustable lengths. FIGS. 10A-13 illustrate various example leg structures that may facilitate adjustment of the overall length of the legs of the table.

Figure 10A:
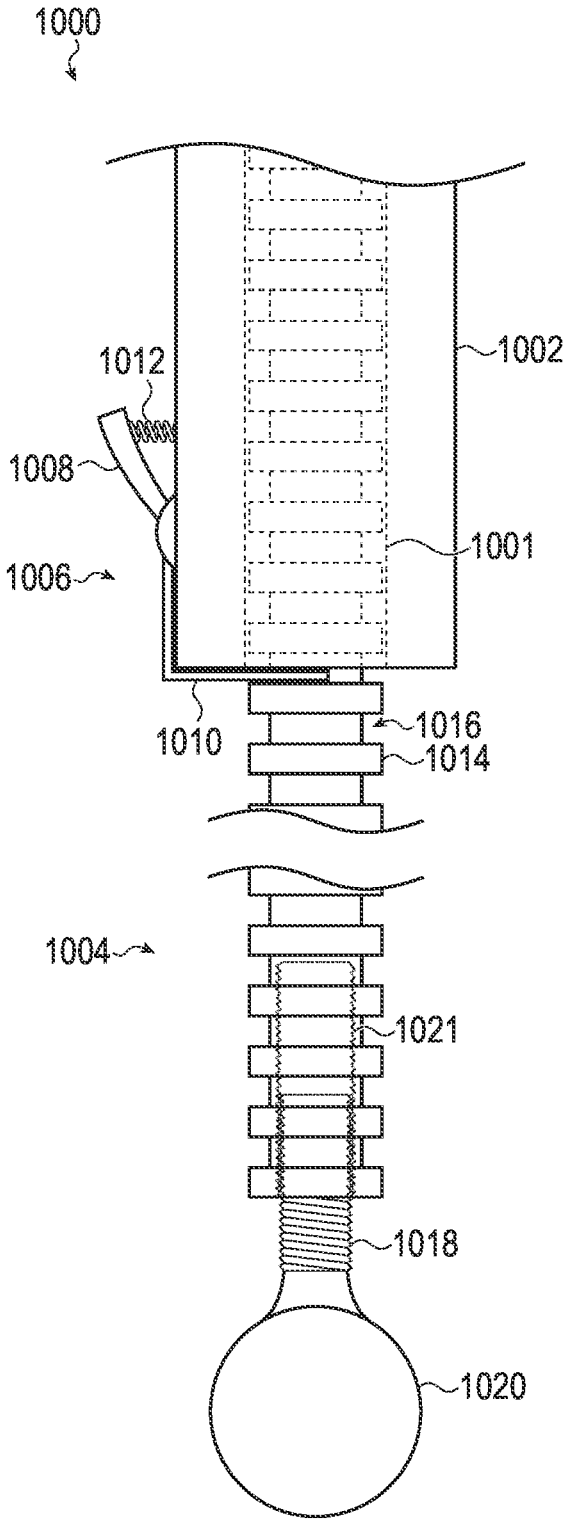
FIGS. 10A-10B depict a portion of an example leg with adjustable length for an articulable leg system.

FIG. 10A illustrates an example leg 1000 that may be used with tables as described herein. The leg 1000 includes an upper strut portion 1002 (which may include or be coupled to a ball portion, as described herein), a lower strut portion 1004, and a foot portion 1020. The lower strut portion 1004 and the upper strut portion 1002 may be telescopic to facilitate leg length adjustments, and the foot portion 1020 may also be adjustable, relative to the lower strut portion 1004, to facilitate fine, precise leg length adjustments. In some cases, the telescoping mechanism (as well as the ball or foot portion adjustments) may allow the legs to extend to up to two times their stowed (e.g., fully retracted) length.

As shown in FIG. 10A, the upper strut portion 1002 may define an axial hole 1001 extending at least a portion of the length of the upper strut portion 1002. The lower strut portion 1004 may extend into the hole 1001, and may be held in a user-specified position (relative to the upper strut portion 1002) by a locking mechanism 1006. The locking mechanism 1006 may have a first mode or configuration (e.g., a locked or latched configuration) in which the lower strut portion 1004 is fixed relative to the upper strut portion 1002, and a second mode or configuration (e.g., an unlocked or unlatched configuration) in which the lower strut portion 1004 can be moved within the hole 1001. For example, in the unlocked configuration, a user can slide the lower strut portion 1004 into or out of the upper strut portion 1002 to establish a desired overall length of the leg 1000, and then lock the lower strut portion 1004 in that position.

The lower strut portion 1004 may define a plurality of retention ridges 1014 (and corresponding recesses 1016) along at least a portion of its length. The retention ridges 1014 may be configured to engage a latch member 1010 of the locking mechanism 1006. For example, the latch member 1010 may define an opening or slot that is sized to extend around the recesses 1016 in the lower strut portion 1004, but smaller than the retention ridges 1014. Thus, when the locking mechanism 1006 is in a locked or secured configuration, the latch member 1010 may be positioned in a recess 1016 and between two retention ridges 1014, such that the latch member 1010 interferes with the retention ridges 1014 and prevents the lower strut portion 1004 from sliding relative to the upper strut portion 1002.

In some cases, the leg is configured so that the lower strut portion 1004 cannot be moved inward or outward without a user manually unlocking the locking mechanism 1006 (e.g., by pressing on a lever 1008 to disengage the latch member 1010 from the lower strut portion 1004). In some cases, however, the leg is configured so that the locking mechanism 1006 acts as a pawl mechanism such that the lower strut portion 1004 can be moved outward without manually unlocking the locking mechanism 1006, but cannot be moved inward. For example, if a user pulls the lower strut portion 1004 outward (relative to the upper strut portion 1002), the retention ridges 1014 may deflect the latch member 1010 so that the retention ridges 1014 can pass the latch member 1010 and the lower strut portion 1004 can be extended. When the user stops extending the lower strut portion 1004, the latch member 1010 may be biased or forced into a recess 1016, thus locking the lower strut portion 1004 into place and preventing it from being retracted or forced into the upper strut portion 1002. When the leg is to be collapsed or shortened, the user can manually unlock or unlatch the locking mechanism 1006 such that the latch member 1010 disengages the retention ridges 1014 and the lower strut portion 1004 can be retracted into the upper strut portion 1002 (or further extended). In some cases, the retention ridges 1014 are shaped to facilitate the pawl or ratchet-like operation described above. For example, an upper surface of a retention ridge 1014 (e.g., the surface that is forced against the latch member 1010 when the table is in use) may be flat or planar, while the lower surface (e.g., the surface that is pulled against the latch member 1010 when the lower strut portion 1004 is pulled outward) may be rounded, chamfered, curved, or otherwise shaped to facilitate the retention ridge 1014 pushing the latch member 1010 out of engagement with the ridge.

The locking mechanism 1006 may include a biasing structure 1012, such as a spring (e.g., a coil spring, a leaf spring, an elastomer member, etc.) that biases the latch member 1010 into engagement with the lower strut portion 1004. The biasing force may therefore need to be overcome (e.g., by manually actuating the lever 1008 and/or forcibly extending the lower strut portion) in order to unlock or unlatch the locking mechanism 1006 to facilitate length adjustments.

In some cases, the lower strut portion (or other movable portion of the leg) may include length graphics in order to aid in positioning the legs at particular lengths. For example, the lower strut portion 1004 may include markings (e.g., color-coded marks, inch markings, etc.) at suitable locations along the length of the lower strut portion 1004. The marks may aid in establishing the legs at target lengths (e.g., a same length for each leg) by extending each leg to a target color-coded mark, hash mark, or length measurement, or other mark. Marks may be provided at certain pre-established leg lengths, for a given table, to position the table at a preselected number of table heights (e.g., 28 inches, 32 inches, 36 inches, and 40 inches, though these are merely examples).

FIG. 10A also illustrates a foot portion 1020 that is adjustable relative to the lower strut portion 1004 to further facilitate length adjustment of the leg 1000. As shown in FIG. 10A, the foot portion 1020 is coupled to a threaded rod 1018, which in turn is received in a threaded hole 1021 that extends axially into the lower strut portion 1004. The threaded rod 1018 may be threaded into or out of the threaded hole 1021 to change the overall length of the leg 1000. The threaded rod 1018 may allow fine adjustments of the length of the leg 1000, and may help ensure that a table can be level and stable on uneven surfaces.

The foot portion 1020 may be a ball-like structure, as shown, or it may be another shape. In some cases, a user may swap between different feet, such as spiked feet (e.g., a single spike), spherical feet, flat feet, or the like, to help make the table stable and secure on different types of surfaces. The foot portion 1020 may be made from various materials, such as polymers, (e.g., a plastic or rubber), metal, or the like. In some cases, the foot portion 1020 and the threaded rod 1018 are formed from a single piece of material (e.g., machined from a single piece of metal, molded as a single piece of plastic, etc.). In other cases, the foot portion 1020 and the threaded rod 1018 are separate components that are coupled together (e.g., via adhesive, interlocking structures, threads, etc.).

Figure 10B:
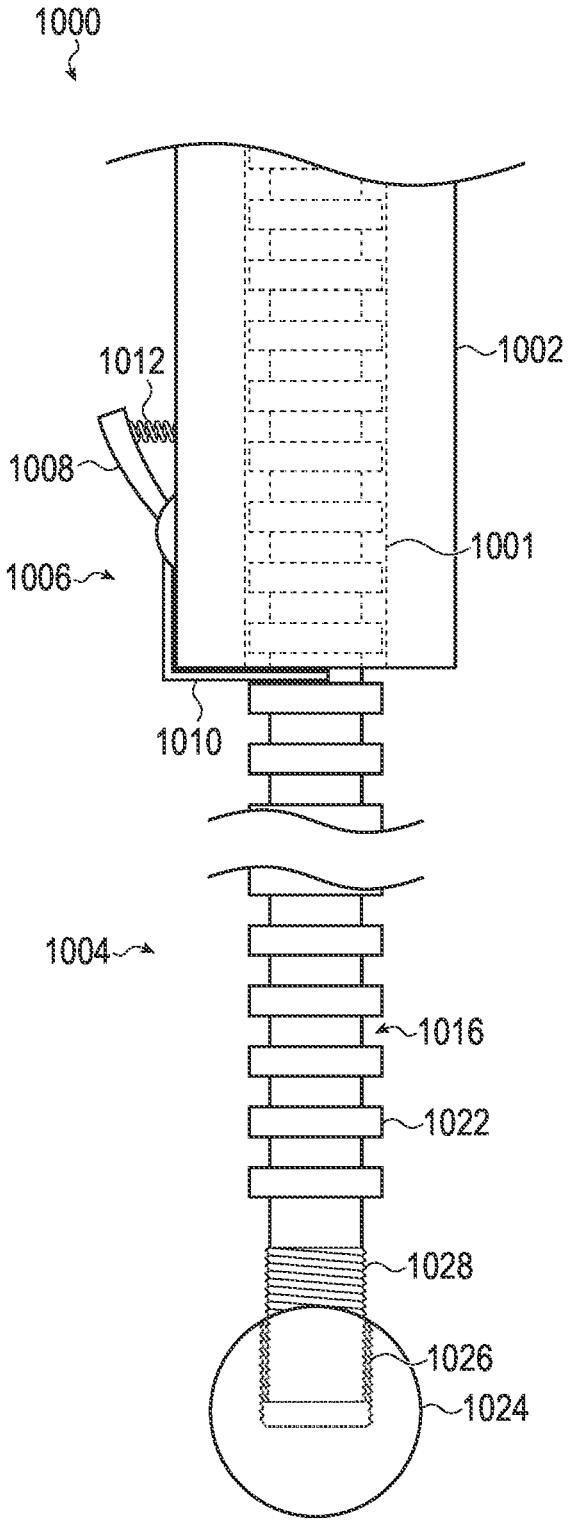

FIG. 10A illustrates a foot portion 1020 that is fixed to a threaded rod, and the threaded rod is threaded into a hole in the lower strut portion 1004. This is merely one example technique for adjustably coupling the foot portion 1020 to the lower strut portion 1004. FIG. 10B, for example, illustrates a portion of a leg in which a foot portion 1024 defines a threaded hole 1026, and a lower strut portion 1022 defines a threaded rod portion 1028. The foot portion 1024 may be adjusted in the same manner as described with respect to FIG. 10A (e.g., by turning the foot to thread it closer or further from the lower strut portion), but in FIG. 10B the foot rotates relative to the threaded rod to change the length of the leg. The threaded rod portion 1028 and the lower strut portion 1022 may be formed from a single piece of material (e.g., machined or otherwise formed from a single piece of metal, molded as a single piece of plastic, etc.). In other cases, the threaded rod portion 1028 and the lower strut portion 1022 are separate components that are coupled together (e.g., via adhesive, interlocking structures, threads, etc.).

Figure 11A:
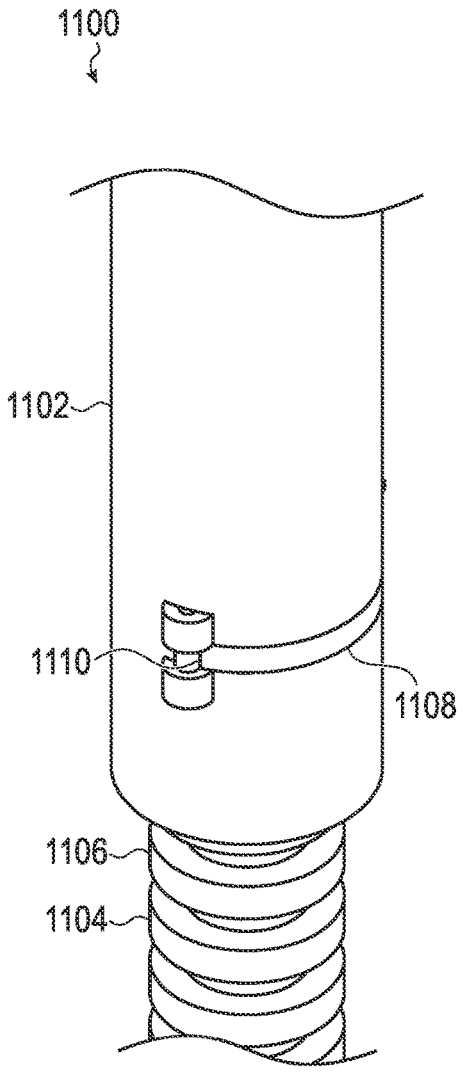
FIGS. 11A-11B depict a portion of another example leg with adjustable length for an articulable leg system.
Figure 11B:
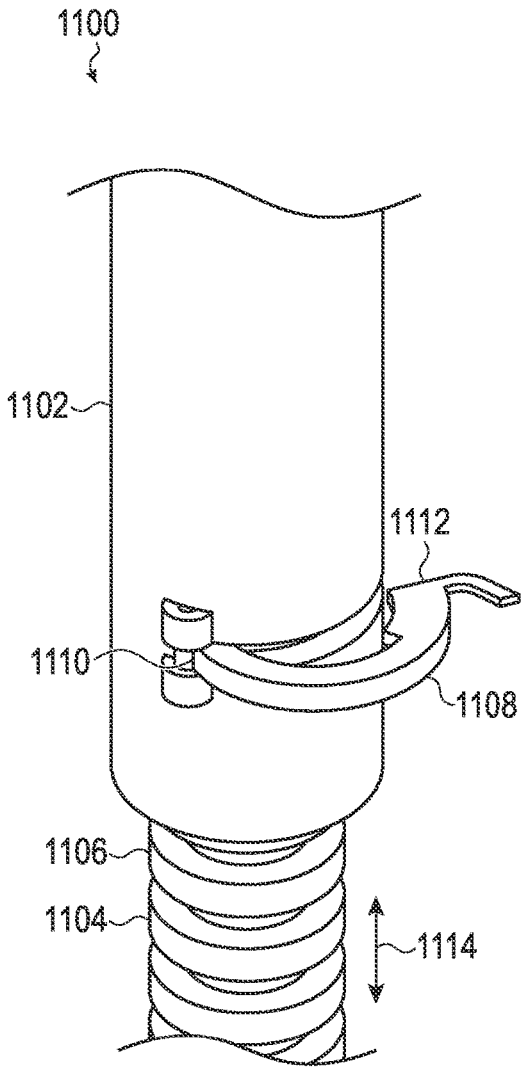

FIGS. 11A-11B illustrate another example mechanism for adjusting the length of a leg 1100. The leg 1100 may include an upper strut portion 1102 and a lower strut portion 1104. The upper strut portion 1102 and lower strut portion 1104 may be similar to and/or embodiments of the upper strut portion 1002 and lower strut portion 1004 of FIGS. 10A-10B. The leg 1100 may include a locking mechanism that includes a pivoting clip 1108 that is articulatably coupled to the upper strut portion 1102 (e.g., via a hinge mechanism 1110). The pivoting clip 1108 may be positionable in a locked position, as shown in FIG. 11A, and an unlocked position, as shown in FIG. 11B. In the locked position, the clip 1108 is positioned at least partially in a slot formed through a wall of the upper strut portion 1102, and a locking tab 1112 of the clip 1108 may be positioned in a recess (e.g., a recess 1016, FIG. 10A) between adjacent retention ridges 1106 of the lower strut portion 1104, thereby preventing the lower strut portion 1104 from being moved into or out of the upper strut portion 1102 (e.g., locking the leg at the target length). In the unlocked position, the locking tab 1112 is disengaged (e.g., not between adjacent retention ridges 1106), such that the lower strut portion 1104 can be moved to the desired position relative to the upper strut portion 1102 (e.g., as indicated by arrow 1114), and then locked into place. The clip 1108 may be biased in the locked position (e.g., by a spring) or otherwise latched or retained in the locked position to prevent inadvertent unlocking.

Figure 12A:
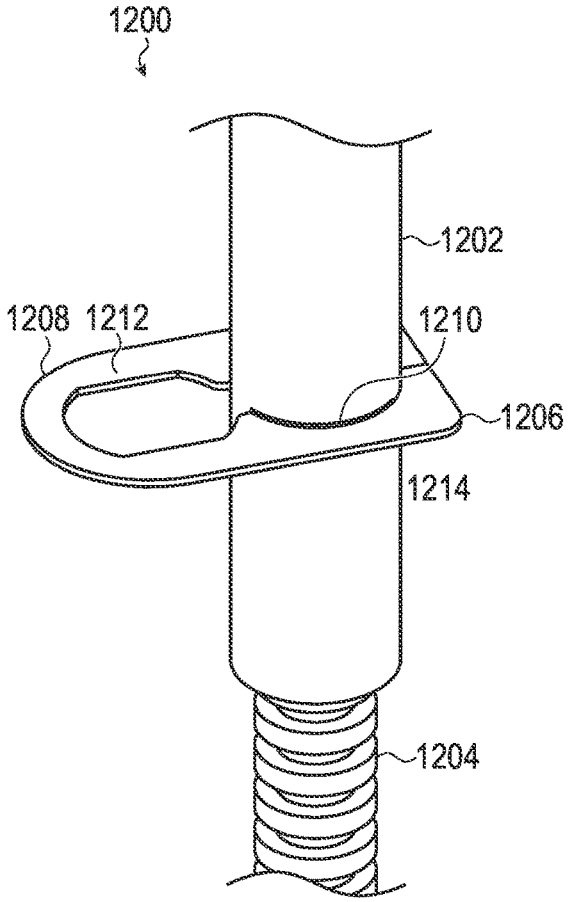
FIGS. 12A-12B depict a portion of another example leg with adjustable length for an articulable leg system.
Figure 12B:
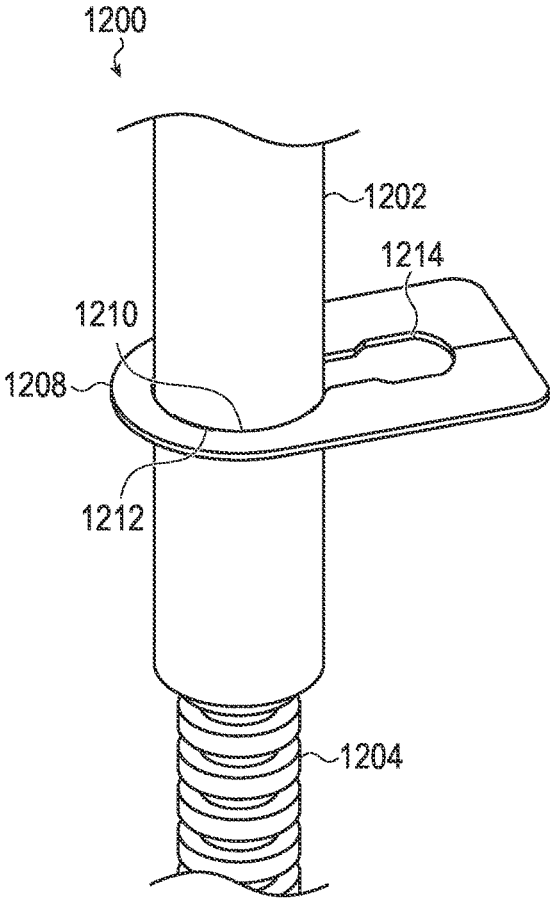

FIGS. 12A-12B illustrate another example mechanism for adjusting the length of a leg 1200. The leg 1200 may include an upper strut portion 1202 and a lower strut portion 1204. The upper strut portion 1202 and lower strut portion 1204 may be similar to and/or embodiments of the upper strut portion 1002 and lower strut portion 1004 of FIGS. 10A-10B. The leg 1200 may also include a foot portion, similar to the foot portion 1020, that can also be adjusted to change the length of the leg.

The leg 1200 may include a locking mechanism that includes a sliding clip 1208 that is slidably coupled to the upper strut portion 1202. The sliding clip 1208 may be positionable in a locked position, as shown in FIG. 12A, and an unlocked position, as shown in FIG. 12B. More particularly, the sliding clip 1208 may be slidable along a pair of slots 1210 positioned on opposite sides of the upper strut portion 1202 (one slot being visible in FIGS. 12A-12B). The pair of slots 1210 and the sliding clip 1208 may be configured so that the sliding clip 1208 is retained to the upper strut portion 1202 (e.g., in the slots) during normal use (e.g., while the sliding clip 1208 is in the locked and in the unlocked positions).

The sliding clip 1208 defines a first opening 1214 and a second opening 1212, wherein the first opening 1214 is smaller than the second opening. In the locked position, the sliding clip 1208 is positioned within the slots 1210 such that portions of the clip 1208 that define the first opening 1214 are positioned in a recess (e.g., a recess 1016, FIG. 10A) between adjacent retention ridges of the lower strut portion 1204, thereby preventing the lower strut portion 1204 from being moved into or out of the upper strut portion 1202 (e.g., locking the leg at the target length). In the unlocked position, the sliding clip 1208 is positioned within the slots 1210 such that portions of the clip 1208 that define the second opening 1212 are still at least partially in the slots 1210 (e.g., so that the clip 1208 does not disengage from the upper strut portion 1202), but the clip does not extend in a recess or otherwise interfere with the telescoping motion of the lower strut portion 1204 relative to the upper strut portion 1202. Thus, in the unlocked position, the lower strut portion 1204 can be moved to the desired position relative to the upper strut portion 1202, and then locked into place by sliding the clip 1208 back into the locked position, as shown in FIG. 12A.

Figure 12C:
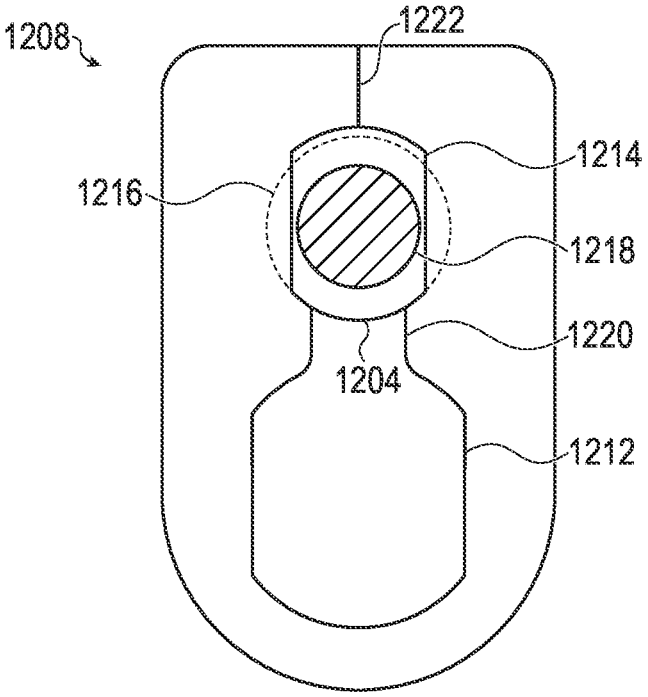
FIGS. 12C-12D depict an example clip for use with a leg with adjustable length.
Figure 12D:
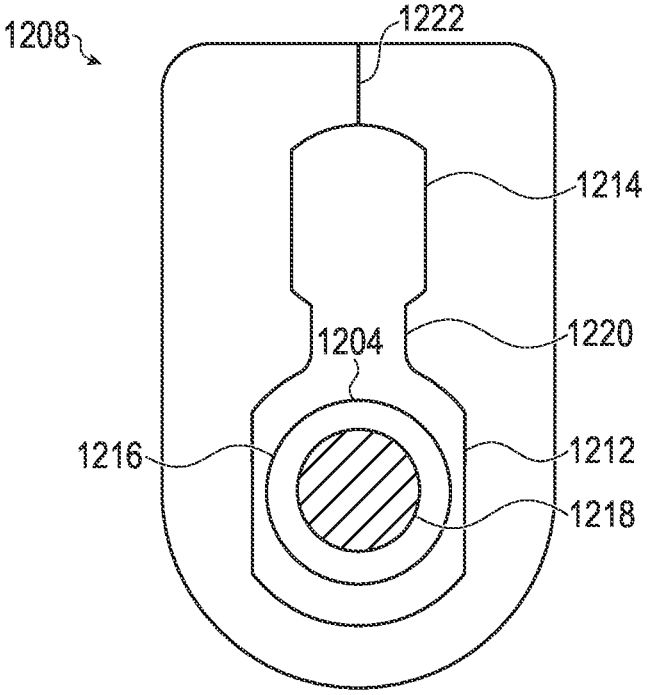

FIGS. 12C-12D illustrate top, partial cross-sectional views of the leg 1200, showing the sliding clip 1208 in the locked and the unlocked positions. For ease of illustration, the upper strut portion 1202 is not shown in FIGS. 12C-12D.

FIG. 12C illustrates the sliding clip 1208 in a locked position, such that the lower strut portion 1204 is positioned in the first opening 1214. As described above, the first opening 1214 may be larger (e.g., in diameter) than the recessed portions of the lower strut portion 1204 (indicated by element 1218), but smaller than the retention ridges (indicated by element 1216). Thus, in the locked position, the sliding clip 1208 overlaps and/or interferes with the retention ridges 1216. And because the sliding clip 1208 is captive to the upper strut portion 1202 (e.g., because it is positioned in the slots 1210), the lower strut portion 1204 cannot move relative to the upper strut portion 1202 when the sliding clip 1208 is in the locked position.

The sliding clip 1208 may be releasably retained in the locked position via a throat region 1220 that is narrower than the recessed portions 1218 of the lower strut portion 1204. In order to move the sliding clip 1208 from the locked position to the unlocked position, a user may push or otherwise force the sliding clip 1208 towards the unlocked position (e.g., upwards, as shown in FIGS. 12C-12D). As a result of this force, the throat region 1220 may contact the recessed portion 1218 of the lower strut portion 1204, which may result in the throat region 1220 expanding or deflecting to allow the sliding clip 1208 to move to the unlocked position. In some cases, the sliding clip 1208 includes a split 1222 (e.g., a cut or other discontinuity in the material of the sliding clip 1208) that allows the sliding clip 1208 to at least partially expand or open to facilitate the expanding of the throat region 1220. Whether or not a split 1222 is provided, the sliding clip 1208 may function as a spring-like structure to retain itself in the locked and/or unlocked position (due to the interference of the throat region 1220 with the lower strut portion 1204), while also allowing the retention force to be overcome by a user manipulation to facilitate the transition between the locked and unlocked positions.

Figure 13:
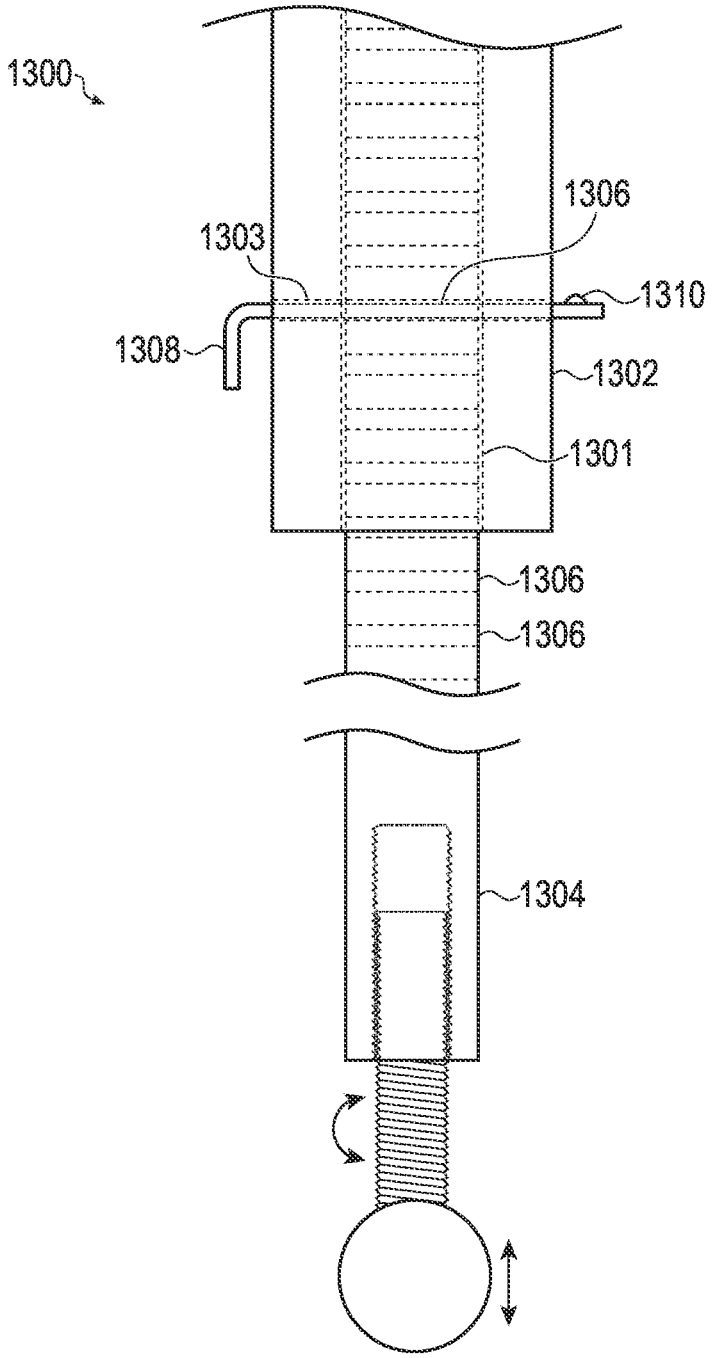
FIG. 13 depicts a portion of another example leg with adjustable length for an articulable leg system.

Once the retention force from the throat region 1220 is overcome, the sliding clip 1208 slides into the unlocked position, as shown in FIG. 12D. In this position, the second opening 1212, which is larger than the retention ridges 1216 of the lower strut portion 1204, is positioned around the lower strut portion 1204. Thus, the sliding clip 1208 does not interfere with the retention ridges 1216, and the lower strut portion 1204 can be moved within the upper strut portion 1202 to adjust the length of the leg. Once the target length is achieved, the sliding clip 1208 can be slid back into the locked position (with the interaction between the throat region 1220 and the lower strut portion 1204 forcing the throat region 1220 to expand and optionally opening the sliding clip 1208 along the split 1222) to retain the leg at the user-established length. FIG. 13 illustrates another example mechanism for adjusting the length of a leg 1300. The leg 1300 may include an upper strut portion 1302 and a lower strut portion 1304. The upper strut portion 1302 and lower strut portion 1304 may be similar to and/or embodiments of the upper strut portion 1002 and lower strut portion 1004 of FIGS. 10A-10B.

In the example of FIG. 13, the upper strut portion 1302 includes a guide hole 1303 through which a pin 1308 may extend. The lower strut portion 1304, which can be positioned in an axial hole 1301 of the upper strut portion 1302, defines a series of through-holes 1306 that are also configured to receive the pin 1308. More particularly, the lower strut portion 1304 may be positioned in the upper strut portion 1302 at a desired length or extension, and the pin 1308 can be inserted through the guide hole 1303 and the through-hole 1306 that is nearest the guide hole 1303 when the lower strut portion 1304 is at the desired length. The pin 1308 therefore retains the lower strut portion 1304 at the user-established length. The leg 1300 may also include a foot portion, similar to the foot portion 1020, that can also be adjusted to change the length of the leg.

The pin 1308 may include a spring detent 1310 to inhibit accidental or unwanted removal of the pin 1308 from the leg. In some cases, the pin 1308 is captive to the upper strut portion 1302, such that it cannot be completely removed from the upper strut portion 1302. In some cases, the pin 1308 may be tethered to the upper strut portion 1302 and/or the table to prevent loss of the pin.

While the foregoing examples illustrate the articulable legs coupled to a table top, the articulable leg systems described herein may be used with other types of structures. For example, articulable legs such as those described herein may be used for chairs, stools, benches, tripods (e.g., for supporting cameras, easels, or the like), tents, or any other object that may benefit from the functionality of the articulable legs, as described herein. When incorporated into other objects, the table tops shown and described may be replaced with a different structure (e.g., a seat of a stool, chair, or bench, a roof of a tent, or the like).

Figure 14A:
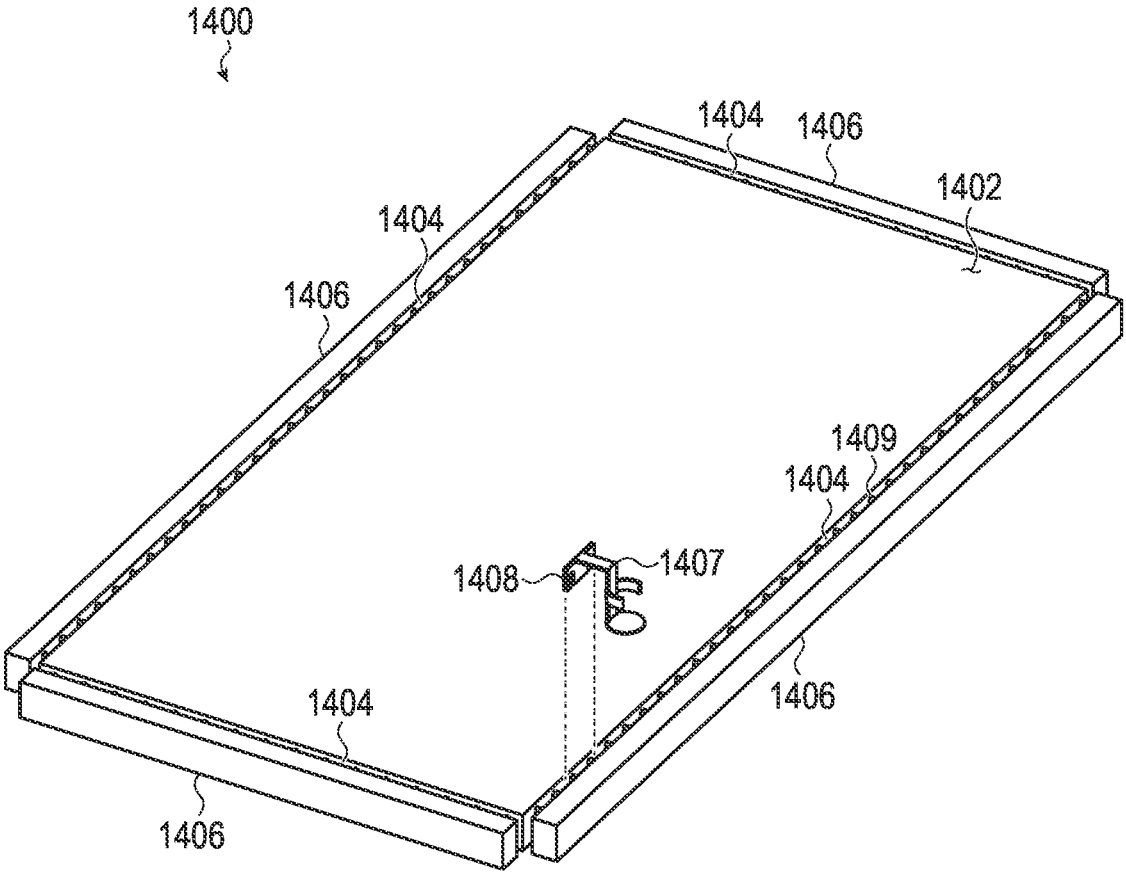
FIGS. 14A-14E depict example modular accessory systems for a table.
Figure 14B:
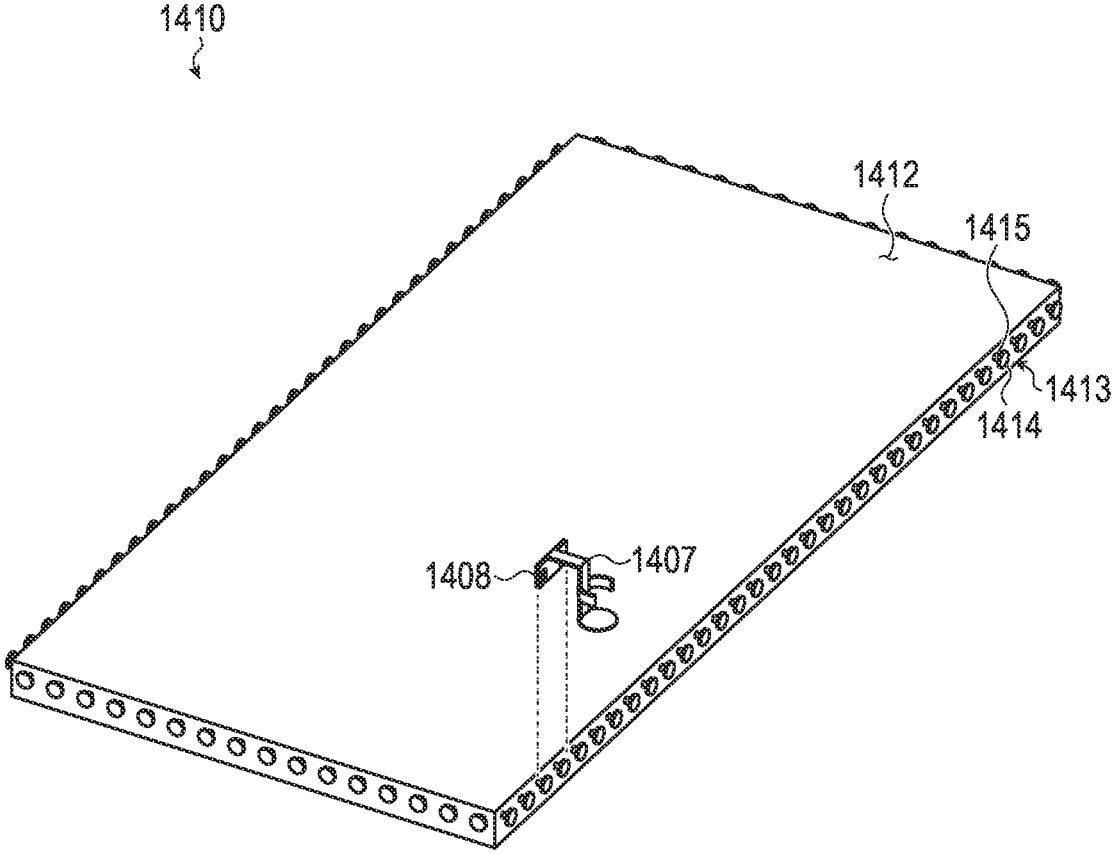
Figure 14C:
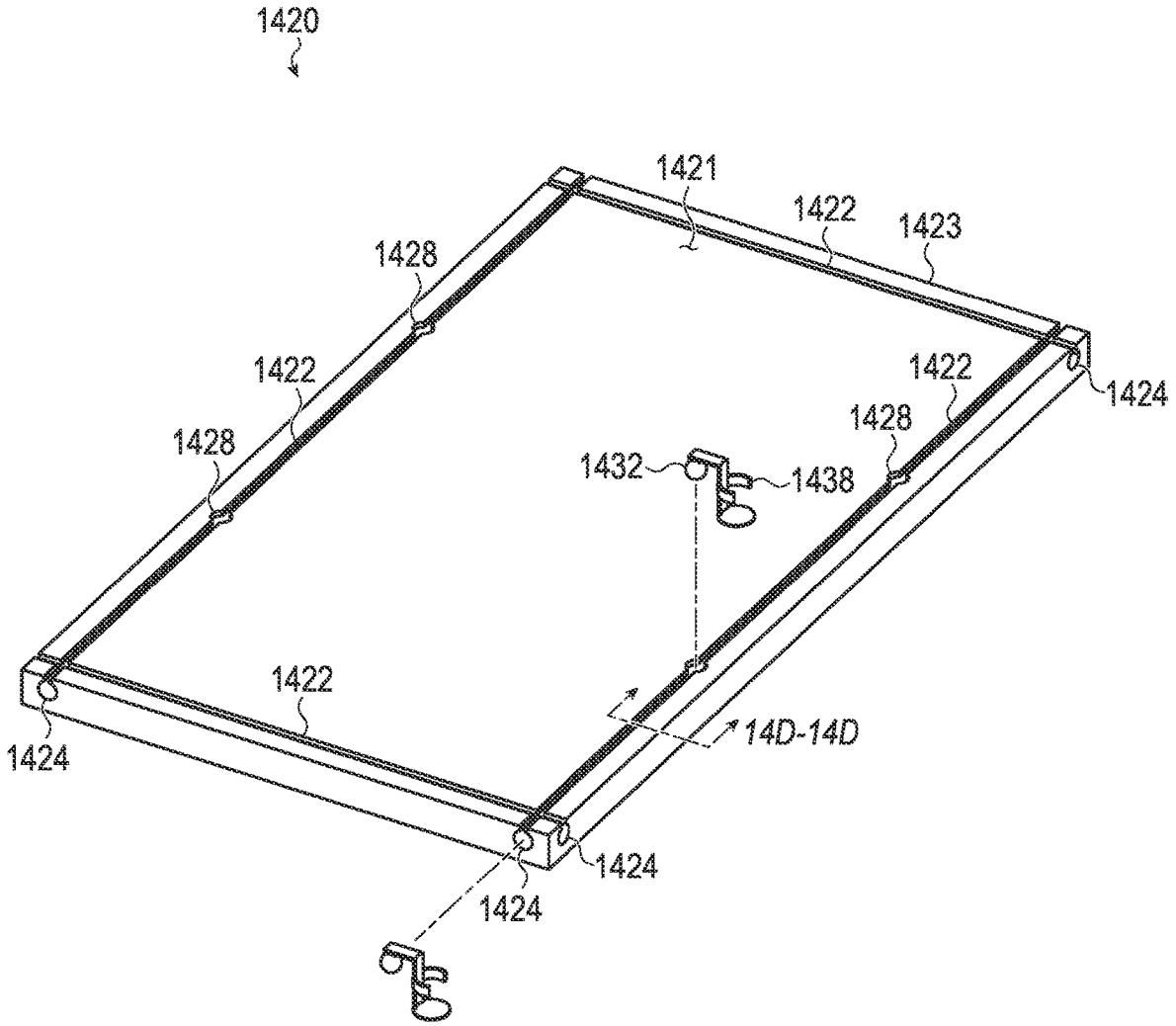

As described herein, the functionality of a portable table may be enhanced by including a modular accessory system in which various accessories may be easily, quickly, and securely attached to the table, and also easily detached from the table for ease of disassembly and storage. FIGS. 14A-15D illustrate example tables and accessories of a modular accessory system. While FIGS. 14A-14C illustrate example tables with modular accessory systems, it will be understood that any table shown or described herein (e.g., the table 100) may include modular accessory systems such as those shown and described with respect to FIGS. 14A-14C. Further, a table with a modular accessory system may use articulatable legs, as described herein, to facilitate stable and level table placement on varied terrains.

FIG. 14A illustrates an example table top 1400 for use with a modular accessory system. The table top 1400 includes a main portion 1402, which defines the main table surface of the table, and a peripheral portion 1406 that is set apart from the main portion 1402 by an accessory retention feature 1404. The accessory retention feature 1404 may extend along one or more of the peripheral sides of the table top 1400. As shown in FIG. 14A, the table top 1400 is rectangular, and the accessory retention feature 1404 extends along each of the four peripheral sides, though this is merely one example. For example, in some cases, the accessory retention feature 1404 extends along only one of the peripheral sides of the table top 1400.

The accessory retention feature 1404 may include a retention slot that is formed between the main portion 1402 and the peripheral portion 1406 of the table top 1400. The retention slot may be configured to receive an engagement feature 1408 of an accessory 1407 therein. (The accessory 1407 is shown as a cup or bottle holder accessory, though this is merely one example accessory that may be used with an accessory retention feature.)

The retention slot and the engagement feature 1408 may be configured to provide a tight or interference fit, such that the accessory 1407 is retained in a fixed position once the engagement feature 1408 is inserted into the retention slot. For example, the width of the retention slot may be substantially the same as the engagement feature 1408, such that the engagement feature 1408 may contact both sides of the retention slot when the engagement feature 1408 is positioned in the slot. One or both of the retention slot or the engagement feature 1408 may be formed from a material that can deform or deflect slightly to allow the engagement feature 1408 to fit into the slot while maintaining contact with both sides of the slot. In some cases, the engagement feature 1408 does not contact both sides of the slot when inserted, but is nevertheless retained in the slot. For example, a clearance may be provided between the surfaces of the slot and the engagement feature 1408.

The accessory retention feature 1404 may also include a series of alignment struts 1409 that extend between the main portion 1402 and the peripheral portion 1406. In some cases, the main portion 1402, peripheral portion 1406, and the alignment struts 1409 are a single, unitary material structure, such as a single piece of molded polymer. In other cases, the alignment struts 1409 structurally couple one or more separate components that define the peripheral portion(s) 1406 to another separate component that defines the main portion 1402. The alignment struts 1409 may be round or cylindrical shafts or rods, or any other suitable shape that engages alignment features on an accessory, as described herein.

Figure 15A:
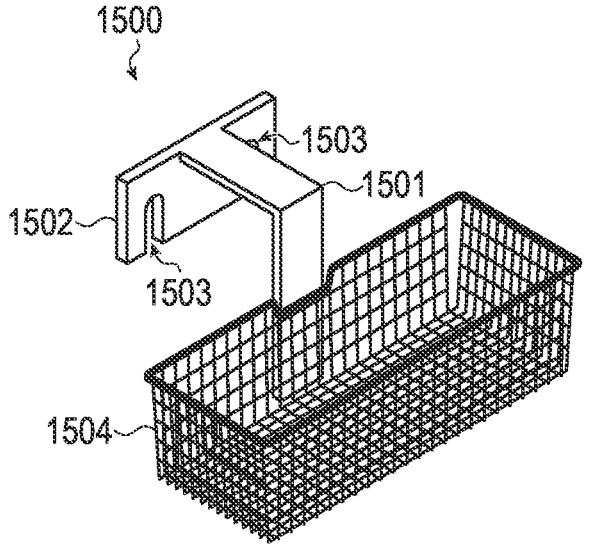
FIGS. 15A-15D depict example accessories for use with a modular accessory system for a table.

The alignment struts 1409 may be configured to engage alignment features on an accessory 1407 to facilitate a secure engagement between the accessory 1407 and to inhibit unwanted shifting or movement of the accessory 1407 once it is engaged with the accessory retention feature 1404. For example, as shown in FIG. 15A, an engagement feature 1502 of an accessory (which may be an embodiment of the engagement feature 1408 in FIG. 14A) includes slots 1503. When the engagement feature 1502 is inserted into the retention slot of a table, the slots 1503 may engage (e.g., receive at least partially therein) respective alignment struts 1409. The alignment struts 1409 may help retain accessories in a user-established location in the retention slot. For example, the engagement between the alignment struts 1409 and the slots of the engagement feature of an accessory may prevent the accessory from sliding within the retention slot.

Further, the alignment struts 1409 and the slots of the accessories may be shaped to provide an interference fit therebetween when the accessory is coupled to the table. For example, the slots may taper (e.g., narrow) proximate the blind end of the slot, such that the slots effectively pinch the alignment struts when the engagement feature is inserted fully into the retention slot. This interference may help prevent unwanted movement of the accessory during use.

FIG. 14B illustrates another example table top 1410 for use with a modular accessory system. The table top 1410 includes a main portion 1412, which defines the main table surface of the table, and accessory retention features 1413 extending from a peripheral side of the main portion 1412. The accessory retention features 1413 may define a shaft 1415 and a cap 1414, which are configured to engage with the engagement feature 1408 of the accessory 1407. For example, the engagement feature 1408 may include a slot (e.g., 1503, FIG. 15A) that is configured to receive a shaft 1415 therein, such that the engagement feature 1408 can be slid onto the accessory retention features 1413. The cap 1414, being larger than the slot, retains the engagement feature on the accessory retention features 1413. In some cases, an accessory may engage multiple accessory retention features 1413, such as shown and described with respect to FIGS. 14A and 15A-15D. The accessory retention features 1413 operate in a manner similar to the alignment struts 1409 and the peripheral portion 1406 described with respect to FIG. 14A, and may be compatible with the same accessories and/or engagement features.

FIG. 14C illustrates another example table top 1420 for use with a modular accessory system. The table top 1420 includes a main portion 1421, which defines the main table surface of the table, and a peripheral portion 1423 that is set apart from the main portion 1421 by an accessory retention feature 1422. The accessory retention feature 1422 may extend along one or more of the peripheral sides of the table top 1420. As shown in FIG. 14C, the table top 1420 is rectangular, and the accessory retention feature 1422 extends along each of the four peripheral sides, though this is merely one example. For example, in some cases, the accessory retention feature 1422 extends along only one of the peripheral sides of the table top 1420.

Figure 14D:
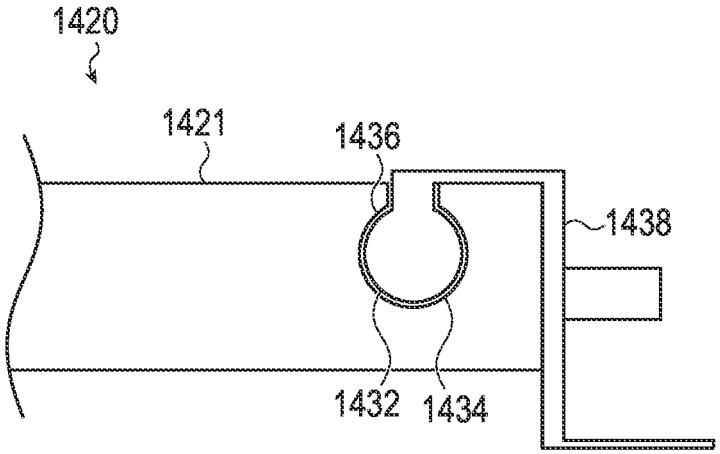

The accessory retention feature 1422 may be or may include a retention slot that is formed between the main portion 1421 and the peripheral portion 1423 of the table top 1420. The retention slot may be configured to receive an engagement feature 1432 of an accessory 1438 therein. The retention slot may define an undercut that engages the engagement feature 1432 to retain the accessory 1438 in the user-established position. For example, FIG. 14D is a partial cross-sectional view of the table top 1420, viewed along line 14D-14D in FIG. 14C. As shown in FIG. 14D, the retention slot includes an opening along the surface of the table top that is narrower than an inner portion 1434 of the retention slot. Thus, the retention slot defines an undercut feature 1436 that at least partially overlaps the engagement feature 1432 to prevent it from decoupling or otherwise being removed from the retention slot. As shown, in FIG. 14D, the inner portion 1434 of the retention slot is substantially circular, and the engagement feature 1432 is also substantially circular in cross-section (e.g., substantially cylindrical or substantially spherical), though other shapes are also possible, such as shown in FIG. 14E described herein.

Returning to FIG. 14C, the accessory retention feature 1422 may also include access openings 1424, 1428, which facilitate insertion of engagement features of accessories into the retention slot. For example, access openings 1428 may be formed at one or more locations along the top surface of the table top 1420, such that engagement features of accessories can be inserted downward into the retention slot, and then (optionally) slid along the retention slot to a location away from the access opening 1428 where the engagement feature is captured in the slot by the undercut region, as described above. Stated another way, the undercut securely retains the accessory 1438 to the table top 1420 in a user-specified location, while allowing the accessory 1438 to be easily moved (e.g., slid within the retention feature) and/or removed from the table. In some cases, a table includes zero, one, two, three, or more access openings 1428 along each side of the table. The access openings 1424 may be positioned at ends of the retention slots, along a side of the table top 1420. The engagement features of accessories may be introduced into the slots through these access openings 1424 and then slid along the retention slot to a location away from the access opening 1428 where the engagement feature is captured in the slot by the undercut region, as described above. Either or both types of access openings may be provided in a table top.

Figure 14E:
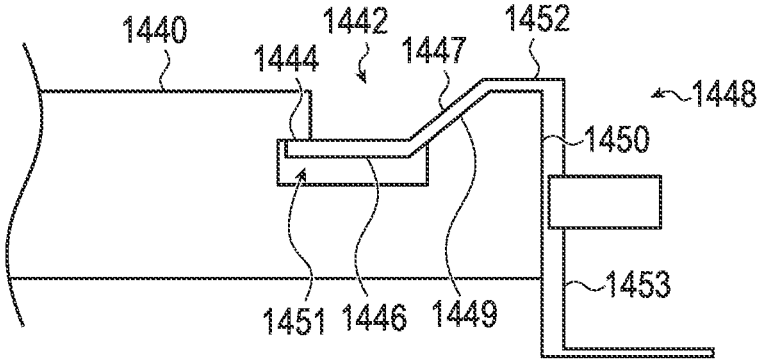

FIG. 14E is a partial cross-sectional view of a table top 1440 that includes another example accessory retention feature 1442. FIG. 14E is a cross-section of the table top 1440 viewed along a line analogous to line 14D-14D in FIG. 14C. As shown in FIG. 14E, the accessory retention feature 1442 includes an opening along the surface of the table top 1440, and a flange portion defining an undercut feature 1444 that is configured to at least partially overlap an engagement feature 1446 of an accessory 1448 to prevent it from decoupling or otherwise being removed from the retention feature 1442. Stated another way, the undercut feature 1444 securely retains the accessory 1448 to the table top 1440 in a user-specified location, while allowing the accessory 1448 to be easily moved (e.g., slid within the retention feature) and/or removed from the table.

The retention feature 1442 also defines a clearance area 1451 that allows the engagement feature 1446 of the accessory 1448 to be inserted into the retention feature 1442 at an angle (e.g., to allow the retention feature 1442 to be positioned under the undercut feature 1444) and be rotated or pivoted into a final position (as shown in FIG. 14E).

In some cases, the table top 1440 and the accessory 1448 define complementary shapes that help secure and retain the accessory 1448 in a stable position. For example, the table top 1440 may define a guide surface 1449 and the accessory 1448 may define a support member 1447 that has a complementary shape, angle, and/or other dimension(s) to intimately mate with the guide surface 1449. For example, as shown in FIG. 14E, the support member 1447 is configured to mate with the guide surface 1449 (e.g., such that the bottom surface of the support member 1447 is in substantially complete contact with the guide surface 1449 along their lengths). Additionally, a vertical member 1453 of the accessory 1448 may be configured to intimately mate with the side or vertical surface 1450 of the table top, and a horizontal member 1452 of the accessory 1448 may be configured to intimately mate with a top or horizontal portion of the table top 1440.

The intimate mating of the accessory 1448 to the table top 1440, as well as the multi-faceted surfaces to which the accessory 1448 ultimately mates, may provide a secure and stable connection between the accessory 1448 and the table top 1440. More particularly, the complementary and snug-fitting shapes of the accessory 1448 and the table top 1440 allow the accessory 1448 to engage (e.g., intimately mate with) multiple surfaces of the table top 1440 in a manner that prevents or inhibits motion in at least one direction. For example, the mating of the accessory 1448 to both the vertical side surface of the table top 1440 as well as the angled guide surface 1449 (which is not perpendicular to the vertical side surface) inhibit motion of the accessory 1448 at least in the horizontal direction (e.g., left-to-right in FIG. 14E). Further, the engagement between the accessory 1448 to the table top 1440 helps maintain the retention feature 1442 in engagement with the undercut feature 1444 (e.g., directly under the undercut feature 1444, such that they maintain an overlapping configuration).

The example accessory shown in FIGS. 14A-14E is shown as a cup or bottle holder. However, this is only one of myriad possible accessories that may be provided for use with a modular accessory system as described herein. FIGS. 15A-15D illustrate additional examples of possible accessories. For example, FIG. 15A illustrates a basket accessory 1500. The basket accessory 1500 includes a basket portion 1504 coupled to an engagement feature 1502 via a joining structure 1501. The basket portion 1504 may be configured for holding various objects, such as dishes, cutlery, food, sports and/or recreation equipment, or the like. The basket portion 1504 may be formed from a mesh (as shown), from solid and/or continuous walls, or the like.

The engagement feature 1502 may define one or more slots 1503. The slots may engage (e.g., receive at least partially therein) respective alignment struts 1409 of an accessory retention feature to help retain the accessory 1500 in a user-established location in a retention slot, as shown and described with respect to FIG. 14A. In some cases, the engagement feature 1502 and the joining structure 1501 are a unitary structure (e.g., formed from a single continuous piece of plastic, metal, fiber-reinforced polymer, etc.).

As shown, the engagement feature 1502 resembles the engagement feature 1408 and may couple to an accessory retention feature 1404 shown in FIG. 14A, and/or the accessory retention feature 1413 shown in FIG. 14B. However, this is merely one example configuration of the engagement feature, and the accessory 1500 may be configured for use with different configurations of accessory retention features. In such cases, the engagement feature 1502 may have a different configuration (e.g., it may resemble the engagement feature 1432, 1446, or a different engagement feature for attaching to a different accessory retention feature).

Figure 15B:
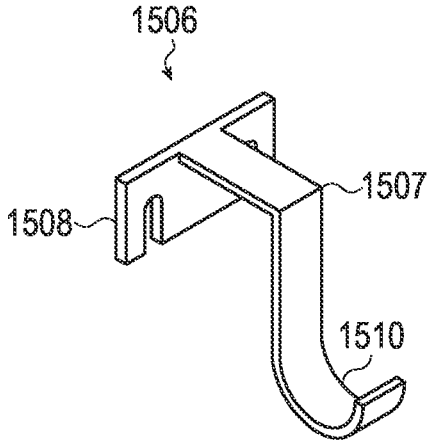

FIG. 15B illustrates a hook accessory 1506. The hook accessory 1506 includes a hook portion 1510 coupled to an engagement feature 1508 via a joining structure 1507. The engagement feature 1508 and the joining structure 1507 may be the same as or similar to those described with respect to FIG. 15A. In some cases, a range of accessories may include various differently sized and shaped hooks for various different potential use cases, as well as hooks formed from different materials (e.g., for holding objects of different weights). For example, a range of hook accessories may include single-hook accessories, multi-hook accessories, pointed hooks, rounded hooks, plastic hooks, metal hooks, etc.

Figure 15C:
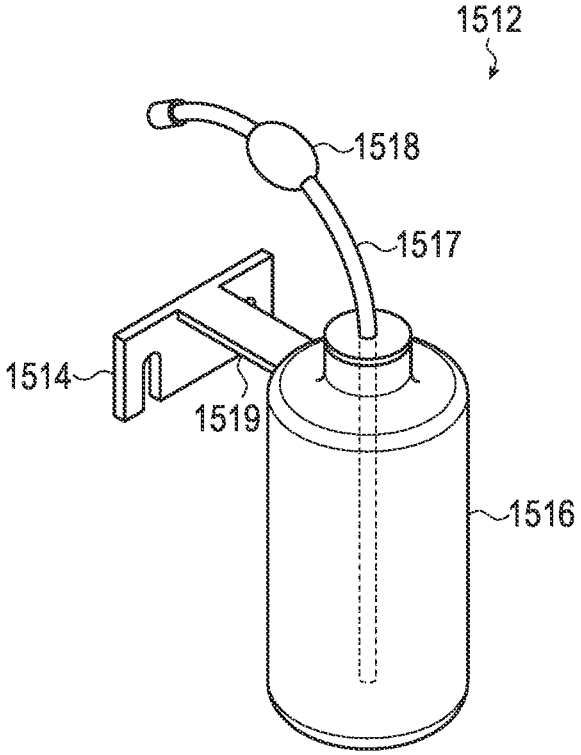

FIG. 15C illustrates a bottle accessory 1512. The bottle accessory 1512 includes a bottle 1516 coupled to an engagement feature 1514 via a joining structure 1519. The engagement feature 1514 and the joining structure 1519 may be the same as or similar to those described with respect to FIG. 15A. The bottle accessory 1512 may optionally include a straw 1517 and, optionally, a pump 1518. The pump 1518 (e.g., a siphon bulb pump or any other suitable pump mechanism) may be configured to draw liquid from the bottle 1516 and through the straw 1517. The bottle accessory 1512 may be used for beverages, cleaning and/or rinsing, dishwashing, or the like. In one example use case, a dishwashing station may be configured on a table using one or more bottle accessories 1512 (e.g., one for soap and water, and one for rinse water), as well as one or more basket accessories 1500 (e.g., for holding dishes while washing, rinsing, and/or drying).

Figure 15D:
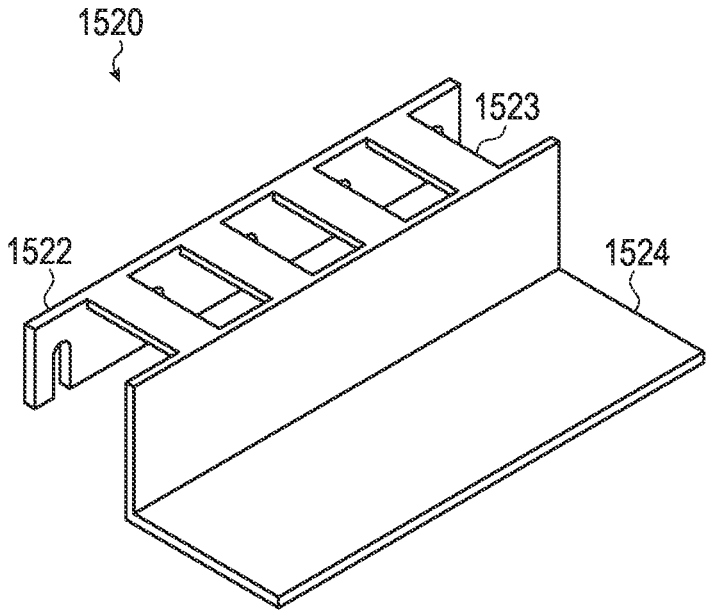

FIG. 15D illustrates a rack accessory 1520. The rack accessory 1520 includes a rack or shelf portion 1524 coupled to an engagement feature 1522 via a joining structure 1523. The engagement feature 1522 and the joining structure 1523 may be the same as or similar to those described with respect to FIG. 15A, though the engagement feature 1522 may be longer (e.g., may occupy a larger length of the accessory retention feature and/or slot than the engagement feature 1502), and may include more slots to accommodate more alignment struts. The shelf portion 1524 may be used for numerous possible applications, such as holding and/or displaying objects (e.g., food, condiments, sporting equipment, cooking utensils, etc.). As additional examples, the shelf portion 1524 may be used as a food preparation surface, cutting board, fish cleaning station, or the like.

While FIGS. 15A-15D illustrate some example accessories that may be used with a modular accessory system, these are merely some examples, and many other types of accessories may be provided. Indeed, any suitable type of accessory may be provided with an engagement feature and optional joining structure (e.g., the engagement feature 1503 and joining structure 1501) that allows the accessory to be removably coupled to a table top. A non-exhaustive list of potential accessories that may be provided with an engagement feature and used in a modular accessory system as described herein includes water bottles, utensil racks, beverage holders, storage shelves, accessory hooks, trays, trash cans, trash bag holders, clips, camp stoves, heaters, lights (e.g., lanterns, flashlights, flashlight holders), fuel canisters, solar panels, backup batteries and battery charging systems, cutting boards, fishing rod holders, removable walls (e.g., to add vertical sides and/or walls to tables), table-connecting accessories (e.g., to securely join multiple tables together), food serving plates or trays, sink basins, faucets, water reservoirs, hunting blind screens, and the like.

The articulating leg system may complement the modular accessory system by allowing a user to customize the table support configuration in order to best support a table with a particular set of coupled accessories. More particularly, because the accessories are configured to hang off of a side of the table, a conventional table may be prone to tipping or otherwise be unstable due to the weight of coupled accessories. In cases where a table includes articulating legs as described herein, each leg may be set to a particular angle and length in order to best support the particular set of accessories being used, and their location on the table. For example, a dishwashing station (including at least one bottle accessory and at least one rack or basket accessory) positioned along one side of a table may add sufficient weight to that side of the table that tipping may be more likely. Accordingly, the legs of the table along the side with the accessories may be oriented at a more outward angle, and be extended to a greater length, than the legs on the opposite side of the table. In this way, the legs may be positioned to provide better stability (e.g., greater resistance to tipping), while maintaining the table top in a level orientation, and without requiring the other legs to be equivalently angled.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings. Also, when used herein to refer to positions of components, the terms above, below, over, under, left, or right (or other similar relative position terms), do not necessarily refer to an absolute position relative to an external reference, but instead refer to the relative position of components within the figure being referred to.

What is claimed is:

1. A table with an articulable leg system, comprising:

a table top;

a plurality of legs configured to support the table top relative to a ground structure;

a leg retention system comprising:

a respective leg retention mechanism for each respective leg of the plurality of legs, each respective leg retention mechanism configured to couple a respective leg of the plurality of legs to the table top and operable in:

an unsecured configuration in which the respective leg is movable, relative to the table top, about at least two angular degrees of freedom; and a secured configuration in which the respective leg is fixed relative to the table top, wherein each respective leg retention mechanism further comprises a biasing spring configured to bias the respective leg retention mechanism in the secured configuration; and a release mechanism operably coupled to each respective leg retention mechanism and configured to:

transition each leg retention mechanism from the secured configuration to the unsecured configuration in response to an actuation of the release mechanism; and allow each leg retention mechanism to transition from the unsecured configuration to the secured configuration in response to the release mechanism being released.

2. The table of claim 1, wherein:
a leg of the plurality of legs comprises:
a ball portion; and
a strut portion; and
a leg retention mechanism of the leg retention system is configured to receive the ball portion therein.

3. The table of claim 2, wherein:
the ball portion is positioned in a socket of the leg retention mechanism; and
the leg retention mechanism comprises:
a base portion fixedly coupled to the table top and defining a first portion of the socket; and
an articulating portion coupled to the base portion and defining a second portion of the socket.

4. The table of claim 3, wherein:
the leg retention mechanism further comprises a latch mechanism; and
in the secured configuration, the latch mechanism secures the base portion of the leg retention mechanism to the articulating portion of the leg retention mechanism and causes the first and second portions of the socket to impart a retention force on the ball portion of the leg.

5. The table of claim 3, wherein the socket comprises a slip-resistant lining.

6. The table of claim 3, wherein:
the ball portion defines a dimpled outer surface; and
the socket defines at least one protrusion configured to:
engage a first dimple of the dimpled outer surface when the ball portion is in a first orientation in the socket; and
engage a second dimple of the dimpled outer surface when the ball portion is in a second orientation in the socket.

7. The table of claim 2, wherein the ball portion comprises:
a body structure formed of a first material; and
an outer structure defining an exterior surface of the ball portion and formed of a second material different than the first material.

8. The table of claim 7, wherein:
the first material is metal; and
the second material is a polymer.

9. The table of claim 2, wherein:
the strut portion is an upper strut portion; and
the leg further comprises a lower strut portion coupled to the upper strut portion and positionable in different positions relative to the upper strut portion to adjust an overall length of the leg.

10. A table with an articulable leg system, comprising:
a table top;
a plurality of legs configured to support the table top relative to a ground structure, each respective leg of the plurality of legs comprising:
a respective ball portion; and
a respective strut portion extending from the respective ball portion; and
a plurality of leg retention mechanisms coupled to a bottom of the table top and configured to couple the plurality of legs to the table top, each respective leg retention mechanism of the plurality of leg retention mechanisms defining a respective socket configured to receive the respective ball portion of a respective leg at least partially therein and operable in:
an unsecured configuration in which the respective ball portion is movable in the respective socket to allow the respective leg to gimbal relative to the table top; and
a secured configuration in which the respective ball portion is fixed within the respective socket to fix a position of the respective leg relative to the table top, the respective leg retention mechanism biased toward the secured configuration; and
a release mechanism operably coupled to each respective leg retention mechanism, the release mechanism configured to:
transition each leg retention mechanism from the secured configuration to the unsecured configuration in response to an actuation of the release mechanism; and
allow each leg retention mechanism to transition from the unsecured configuration to the secured configuration in response to the release mechanism being released.

11. The table of claim 10, wherein a ball portion of a leg of the plurality of legs is attached to a strut portion of the leg via a threaded post.

12. The table of claim 10 wherein:
a leg of the plurality of legs further comprises a foot portion coupled to a strut portion of the leg; and
the foot portion is positionable in different positions relative to the strut portion to adjust an overall length of the leg.

13. The table of claim 12, wherein:
the strut portion comprises:
an upper strut portion; and
a lower strut portion coupled to the upper strut portion and positionable in different positions relative to the upper strut portion to adjust the overall length of the leg; and
the foot portion is coupled to the lower strut portion.

14. The table of claim 10, further comprising a slip-resistant coating positioned on at least one of the respective ball portion of the respective leg or a surface of the respective socket.

15. A table system with a modular accessory system, comprising:
a table top;
a set of four legs coupled to a bottom of the table top and configured to support the table top relative to a ground structure, each respective leg configured to gimbal relative to the table top independently of each other leg, each respective leg corresponding to a respective leg retention mechanism, the respective leg retention mechanism operable in:
an unlocked configuration in which a respective leg is movable relative to the table top; and
a locked configuration in which the respective leg is fixed relative to the table top, the respective leg retention mechanism biased toward the locked configuration; and
a release mechanism configured to:
transition each respective leg retention mechanism from the locked configuration to the unlocked configuration in response to an actuation of the release mechanism; and
allow each respective leg retention mechanism to transition from the unlocked configuration to the locked configuration in response to the release mechanism being released; wherein:
the table top defines an accessory retention feature along at least one peripheral side of the table top and configured to removably retain a table accessory to the table top.

16. The table system of claim 15, wherein the accessory retention feature is an accessory retention slot configured to receive an engagement feature of the table accessory therein.

17. The table system of claim 16, wherein the table accessory is positionable at multiple locations along the accessory retention slot.

18. The table system of claim 16, wherein the accessory retention slot defines an undercut region configured to retain the table accessory to the table top.

19. The table system of claim 16, further comprising an alignment strut positioned in the accessory retention slot and configured to engage with an alignment feature of the table accessory to inhibit motion of the table accessory within the accessory retention slot.

20. The table system of claim 16, wherein the table accessory is selected from the group consisting of:

a cup holder;
a hook;
a basket;
a shelf; and
a bottle.

* * * * *